US008506325B2

(12) United States Patent
Malloy et al.

(10) Patent No.: US 8,506,325 B2
(45) Date of Patent: Aug. 13, 2013

(54) CABLE CONNECTOR HAVING A BIASING ELEMENT

(75) Inventors: Allen L. Malloy, Elmira Heights, NY (US); Julio F. Rodrigues, Collierville, TN (US)

(73) Assignee: Belden Inc., St. Louis, MO (US)

( * ) Notice: Subject to any disclaimer, the term of this patent is extended or adjusted under 35 U.S.C. 154(b) by 0 days.

(21) Appl. No.: 13/290,820

(22) Filed: Nov. 7, 2011

(65) Prior Publication Data

US 2012/0171894 A1 Jul. 5, 2012

Related U.S. Application Data

(63) Continuation of application No. 12/568,160, filed on Sep. 28, 2009, now Pat. No. 8,062,063.

(60) Provisional application No. 61/101,185, filed on Sep. 30, 2009, provisional application No. 61/101,191, filed on Sep. 30, 2008, provisional application No. 61/155,246, filed on Feb. 25, 2009, provisional application No. 61/155,297, filed on Feb. 25, 2009, provisional application No. 61/155,252, filed on Feb. 25, 2009, provisional application No. 61/155,250, filed on Feb. 25, 2009, provisional application No. 61/155,289, filed on Feb. 25, 2009, provisional application No. 61/155,249, filed on Feb. 25, 2009, provisional application No. 61/175,613, filed on May 5, 2009, provisional application No. 61/242,884, filed on Sep. 16, 2009.

(51) Int. Cl.
*H01R 9/05* (2006.01)

(52) U.S. Cl.
USPC ..... 439/578; 439/584

(58) Field of Classification Search
USPC ..... 439/578, 583, 584, 585, 321
See application file for complete search history.

(56) References Cited

U.S. PATENT DOCUMENTS 1,371,742 A 3/1921 Dringman
1,667,485 A 4/1928 MacDonald (Continued)

FOREIGN PATENT DOCUMENTS

CA 2096710 11/1994
CN 201149936 11/2008

(Continued)

OTHER PUBLICATIONS

Notice of Allowance for U.S. Appl. No. 12/568,149, mail date Oct. 7, 2011, 5 pages.

(Continued)

*Primary Examiner* — Hae Moon Hyeon
(74) *Attorney, Agent, or Firm* — Schmeiser, Olsen & Watts LLP

(57) ABSTRACT

A coaxial cable connector for coupling a coaxial cable to a mating connector includes a connector body having a forward end and a rearward cable receiving end for receiving the cable. A nut is rotatably coupled to the forward end of the connector body. An annular post is disposed within the connector body, the post having a forward flanged base portion disposed within a rearward extent of the nut, the forward flanged base portion having a forward face. A biasing element is attached to the forward flanged base portion of the post and includes a deflectable portion extending outwardly in a forward direction beyond the forward face of the post shoulder portion.

21 Claims, 18 Drawing Sheets

(56) References Cited

U.S. PATENT DOCUMENTS

| | | | |
|---|---|---|---|
| 1,734,506 | A | 11/1929 | Walter |
| 1,766,869 | A | 6/1930 | Austin |
| 1,801,999 | A | 4/1931 | Bowman |
| 1,885,761 | A | 11/1932 | Peirce, Jr. |
| 2,102,495 | A | 12/1937 | England |
| 2,258,737 | A | 10/1941 | Browne |
| 2,325,549 | A | 7/1943 | Zublin |
| 2,394,351 | A | 2/1946 | Wurzburger |
| 2,460,304 | A | 2/1949 | McGee et al. |
| 2,480,963 | A | 9/1949 | Quinn |
| 2,544,654 | A | 3/1951 | Browne |
| 2,544,764 | A | 3/1951 | Parks |
| 2,549,647 | A | 4/1951 | Turenne |
| 2,694,187 | A | 11/1954 | Nash |
| 2,728,895 | A | 12/1955 | Quackenbush et al. |
| 2,754,487 | A | 7/1956 | Carr et al. |
| 2,755,331 | A | 7/1956 | Melcher |
| 2,757,351 | A | 7/1956 | Klostermann |
| 2,761,110 | A | 8/1956 | Edlen et al. |
| 2,762,025 | A | 9/1956 | Melcher |
| 2,795,144 | A | 6/1957 | Morse |
| 2,805,399 | A | 9/1957 | Leeper |
| 2,870,420 | A | 1/1959 | Malek |
| 2,983,893 | A | 5/1961 | Jackson |
| 2,999,701 | A | 9/1961 | Blair et al. |
| 3,001,169 | A | 9/1961 | Blonder |
| 3,015,794 | A | 1/1962 | Kishbaugh |
| 3,040,288 | A | 6/1962 | Edlen et al. |
| 3,051,925 | A | 8/1962 | Felts |
| 3,091,748 | A | 5/1963 | Takes et al. |
| 3,094,364 | A | 6/1963 | Lingg |
| 3,103,548 | A | 9/1963 | Concelman |
| 3,184,706 | A | 5/1965 | Atkins |
| 3,194,292 | A | 7/1965 | Borowsky |
| 3,196,382 | A | 7/1965 | Morello, Jr. |
| 3,206,540 | A | 9/1965 | Cohen |
| 3,245,027 | A | 4/1966 | Ziegler, Jr. |
| 3,275,913 | A | 9/1966 | Blanchard et al. |
| 3,275,970 | A | 9/1966 | Johanson et al. |
| 3,278,890 | A | 10/1966 | Cooney |
| 3,281,757 | A | 10/1966 | Bonhomme |
| 3,292,136 | A | 12/1966 | Somerset |
| 3,295,076 | A | 12/1966 | Kraus |
| 3,297,979 | A | 1/1967 | O'Keefe et al. |
| 3,320,575 | A | 5/1967 | Brown et al. |
| 3,321,732 | A | 5/1967 | Forney, Jr. |
| 3,336,562 | A | 8/1967 | McCormick et al. |
| 3,336,563 | A | 8/1967 | Hyslop |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,384,703 | A | 5/1968 | Forney et al. |
| 3,390,374 | A | 6/1968 | Forney, Jr. |
| 3,406,373 | A | 10/1968 | Forney, Jr. |
| 3,430,184 | A | 2/1969 | Acord |
| 3,448,430 | A | 6/1969 | Kelly |
| 3,453,376 | A | 7/1969 | Ziegler et al. |
| 3,465,281 | A | 9/1969 | Florer |
| 3,467,940 | A | 9/1969 | Wallo |
| 3,471,158 | A | 10/1969 | Solins |
| 3,475,545 | A | 10/1969 | Stark et al. |
| 3,494,400 | A | 2/1970 | McCoy et al. |
| 3,498,647 | A | 3/1970 | Schroder |
| 3,501,737 | A | 3/1970 | Harris et al. |
| 3,517,373 | A | 6/1970 | Jamon |
| 3,526,871 | A | 9/1970 | Hobart |
| 3,533,051 | A | 10/1970 | Ziegler, Jr. |
| 3,537,065 | A | 10/1970 | Winston |
| 3,538,464 | A | 11/1970 | Walsh |
| 3,544,705 | A | 12/1970 | Winston |
| 3,551,882 | A | 12/1970 | O'Keefe |
| 3,564,487 | A | 2/1971 | Upstone et al. |
| 3,573,677 | A | 4/1971 | Detar |
| 3,579,155 | A | 5/1971 | Tuchto |
| 3,587,033 | A | 6/1971 | Brorein et al. |
| 3,591,208 | A | 7/1971 | Nicolaus |
| 3,594,694 | A | 7/1971 | Clark |
| 3,601,776 | A | 8/1971 | Curl |
| 3,613,050 | A | 10/1971 | Andrews |
| 3,629,792 | A | 12/1971 | Dorrell |
| 3,633,150 | A | 1/1972 | Swartz |
| 3,633,944 | A | 1/1972 | Hamburg |
| 3,644,874 | A | 2/1972 | Hutter |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,444 | A | 7/1972 | Stevens et al. |
| 3,678,445 | A | 7/1972 | Brancaleone |
| 3,678,455 | A | 7/1972 | Levey |
| 3,680,034 | A | 7/1972 | Chow et al. |
| 3,681,739 | A | 8/1972 | Kornick |
| 3,683,320 | A | 8/1972 | Woods et al. |
| 3,684,321 | A | 8/1972 | Hundhausen et al. |
| 3,686,623 | A | 8/1972 | Nijman |
| 3,694,792 | A | 9/1972 | Wallo |
| 3,706,958 | A | 12/1972 | Blanchenot |
| 3,710,005 | A | 1/1973 | French |
| 3,721,869 | A | 3/1973 | Paoli |
| 3,739,076 | A | 6/1973 | Schwartz |
| 3,743,979 | A | 7/1973 | Schor |
| 3,744,007 | A | 7/1973 | Horak |
| 3,744,011 | A | 7/1973 | Blanchenot |
| 3,745,514 | A | 7/1973 | Brishka |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,858,156 | A | 12/1974 | Zarro |
| 3,870,978 | A | 3/1975 | Dreyer |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,953,098 | A | 4/1976 | Avery et al. |
| 3,960,428 | A | 6/1976 | Naus et al. |
| 3,961,294 | A | 6/1976 | Hollyday |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,012,105 | A | 3/1977 | Biddle |
| 4,017,139 | A | 4/1977 | Nelson |
| 4,022,966 | A | 5/1977 | Gajajiva |
| 4,030,798 | A | 6/1977 | Paoli |
| 4,045,706 | A | 8/1977 | Daffner et al. |
| 4,046,451 | A | 9/1977 | Juds et al. |
| 4,051,447 | A | 9/1977 | Heckman, Jr. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,109,126 | A | 8/1978 | Halbeck |
| 4,125,308 | A | 11/1978 | Schilling |

4,126,372 A 11/1978 Hashimoto et al.
4,131,332 A 12/1978 Hogendobler et al.
4,150,250 A 4/1979 Lundeberg
4,153,320 A 5/1979 Townshend
4,156,554 A 5/1979 Aujla
4,165,911 A 8/1979 Laudig
4,168,921 A 9/1979 Blanchard
4,172,385 A 10/1979 Cristensen
4,173,385 A 11/1979 Fenn et al.
4,174,875 A 11/1979 Wilson et al.
4,187,481 A 2/1980 Boutros
4,191,408 A 3/1980 Acker
4,225,162 A 9/1980 Dola
4,227,765 A 10/1980 Neumann et al.
4,229,714 A 10/1980 Yu
4,235,461 A 11/1980 Normark
4,250,348 A 2/1981 Kitagawa
4,255,011 A 3/1981 Davis et al.
4,258,943 A 3/1981 Vogt et al.
4,280,749 A 7/1981 Hemmer
4,285,564 A 8/1981 Spinner
4,290,663 A 9/1981 Fowler et al.
4,296,986 A 10/1981 Herrmann, Jr.
4,307,926 A 12/1981 Smith
4,322,121 A 3/1982 Riches et al.
4,326,769 A 4/1982 Dorsey et al.
4,339,166 A 7/1982 Dayton
4,340,269 A 7/1982 McGeary
4,346,958 A 8/1982 Blanchard
4,354,721 A 10/1982 Luzzi
4,358,174 A 11/1982 Dreyer
4,373,767 A 2/1983 Cairns
4,389,081 A 6/1983 Gallusser et al.
4,400,050 A 8/1983 Hayward
4,406,483 A 9/1983 Perlman
4,407,529 A 10/1983 Holman
4,408,821 A 10/1983 Forney, Jr.
4,408,822 A 10/1983 Nikitas
4,412,717 A 11/1983 Monroe
4,421,377 A 12/1983 Spinner
4,426,127 A 1/1984 Kubota
4,444,453 A 4/1984 Kirby et al.
4,452,503 A 6/1984 Forney, Jr.
4,456,323 A 6/1984 Pitcher et al.
4,462,653 A 7/1984 Flederbach et al.
4,464,000 A 8/1984 Werth et al.
4,464,001 A 8/1984 Collins
4,469,386 A 9/1984 Ackerman
4,470,657 A 9/1984 Deacon
4,484,792 A 11/1984 Tengler et al.
4,484,796 A 11/1984 Sato et al.
4,490,576 A 12/1984 Bolante et al.
4,506,943 A 3/1985 Drogo
4,515,427 A 5/1985 Smit
4,525,017 A 6/1985 Schildkraut et al.
4,531,790 A 7/1985 Selvin
4,531,805 A 7/1985 Werth
4,533,191 A 8/1985 Blackwood
4,540,231 A 9/1985 Forney, Jr.
RE31,995 E 10/1985 Ball
4,545,633 A 10/1985 McGeary
4,545,637 A 10/1985 Bosshard et al.
4,557,546 A 12/1985 Dreyer
4,557,654 A 12/1985 Masuda et al.
4,561,716 A 12/1985 Acke
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney et al.
4,596,434 A 6/1986 Saba et al.
4,596,435 A 6/1986 Bickford
4,597,620 A 7/1986 Lindner et al.
4,597,621 A 7/1986 Burns
4,598,959 A 7/1986 Selvin
4,598,961 A 7/1986 Cohen
4,600,263 A 7/1986 DeChamp et al.
4,613,119 A 9/1986 Hardtke
4,613,199 A 9/1986 McGeary
4,614,390 A 9/1986 Baker
4,616,900 A 10/1986 Cairns
4,632,487 A 12/1986 Wargula
4,634,213 A 1/1987 Larsson et al.
4,640,572 A 2/1987 Conlon
4,645,281 A 2/1987 Burger
4,650,228 A 3/1987 McMills et al.
4,655,159 A 4/1987 McMills
4,655,534 A 4/1987 Stursa
4,660,921 A 4/1987 Hauver
4,668,043 A 5/1987 Saba et al.
4,673,236 A 6/1987 Musolff et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,702,710 A 10/1987 Dittman et al.
4,703,987 A 11/1987 Gallusser et al.
4,703,988 A 11/1987 Raux et al.
4,717,355 A 1/1988 Mattis
4,720,155 A 1/1988 Schildkraut et al.
4,731,282 A 3/1988 Tsukagoshi et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,777,669 A 10/1988 Rogus
4,789,355 A 12/1988 Lee
4,793,821 A 12/1988 Fowler et al.
4,797,120 A 1/1989 Ulery
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,820,446 A 4/1989 Prud'Homme
4,824,400 A 4/1989 Spinner
4,834,675 A 5/1989 Samchisen
4,835,342 A 5/1989 Guginsky
4,836,801 A 6/1989 Ramirez
4,838,813 A 6/1989 Pauza et al.
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,878,697 A 11/1989 Henry
4,887,950 A 12/1989 Sakayori et al.
4,892,275 A 1/1990 Szegda
4,897,008 A 1/1990 Parks
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,971,727 A 11/1990 Takahashi et al.

4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,139 A 10/1991 Spinner
5,059,747 A 10/1991 Bawa et al.
5,062,804 A 11/1991 Jamet et al.
5,066,248 A 11/1991 Gaver et al.
5,073,129 A 12/1991 Szegda
5,080,600 A 1/1992 Baker et al.
5,083,943 A 1/1992 Tarrant
5,100,341 A 3/1992 Czyz et al.
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin et al.
5,169,323 A 12/1992 Kawai et al.
5,181,161 A 1/1993 Hirose et al.
5,183,417 A 2/1993 Bools
5,186,501 A 2/1993 Mano
5,186,655 A 2/1993 Glenday et al.
5,192,219 A 3/1993 Fowler et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,221,216 A 6/1993 Gabany et al.
5,227,093 A 7/1993 Cole et al.
5,227,587 A 7/1993 Paterek
5,247,424 A 9/1993 Harris et al.
5,269,701 A 12/1993 Leibfried, Jr.
5,280,254 A 1/1994 Hunter et al.
5,281,167 A 1/1994 Le et al.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,316,499 A 5/1994 Scannelli et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,359,735 A 11/1994 Stockwell
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawaguchi et al.
5,389,005 A 2/1995 Kodama
5,393,244 A 2/1995 Szegda
5,397,252 A 3/1995 Wang
5,409,398 A 4/1995 Chadbourne et al.
5,413,504 A 5/1995 Kloecker et al.
5,417,588 A 5/1995 Olson et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,464,661 A 11/1995 Lein et al.
5,466,173 A 11/1995 Down
5,470,257 A 11/1995 Szegda
5,474,478 A 12/1995 Ballog
5,490,033 A 2/1996 Cronin
5,490,801 A 2/1996 Fisher et al.
5,494,454 A 2/1996 Johnsen
5,496,076 A 3/1996 Lin
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,595,502 A 1/1997 Allison
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,690,503 A 11/1997 Konda et al.
5,695,365 A 12/1997 Kennedy et al.
5,696,196 A 12/1997 DiLeo
5,702,262 A 12/1997 Brown et al.
5,702,263 A 12/1997 Baumann et al.
5,722,856 A 3/1998 Fuchs et al.
5,735,704 A 4/1998 Anthony
5,746,617 A 5/1998 Porter et al.
5,746,619 A 5/1998 Harting et al.
5,769,652 A 6/1998 Wider
5,770,216 A 6/1998 Mitchnick et al.
5,775,927 A 7/1998 Wider
5,788,666 A 8/1998 Atanasoska
5,857,865 A 1/1999 Shimirak et al.
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,949,029 A 9/1999 Crotzer et al.
5,956,365 A 9/1999 Haissig
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,019,636 A 2/2000 Langham
6,022,237 A 2/2000 Esh
6,032,358 A 3/2000 Wild
6,042,422 A 3/2000 Youtsey
6,048,229 A 4/2000 Lazaro, Jr.
6,053,769 A 4/2000 Kubota et al.
6,053,777 A 4/2000 Boyle 6,083,053 A 7/2000 Anderson et al.
6,089,903 A 7/2000 Stafford Gray et al.
6,089,912 A 7/2000 Tallis et al.
6,089,913 A 7/2000 Holliday
6,106,314 A 8/2000 McLean et al.
6,117,539 A 9/2000 Crotzer et al.
6,123,567 A 9/2000 McCarthy
6,123,581 A 9/2000 Stabile et al.
6,146,179 A 11/2000 Denny et al.
6,146,197 A 11/2000 Holliday et al.
6,152,753 A 11/2000 Johnson et al.
6,153,830 A 11/2000 Montena
6,168,211 B1 1/2001 Schorn-Gilson
6,180,221 B1 1/2001 Crotzer et al.
6,210,216 B1 4/2001 Tso-Chin et al.
6,210,222 B1 4/2001 Langham et al.
6,217,383 B1 4/2001 Holland et al.
RE37,153 E 5/2001 Henszey et al.
6,239,359 B1 5/2001 Lilienthal et al.
6,241,553 B1 6/2001 Hsia
6,251,553 B1 6/2001 Baur et al.
6,261,126 B1 7/2001 Stirling
6,267,612 B1 7/2001 Arcykiewicz et al.
6,271,464 B1 8/2001 Cunningham
6,331,123 B1 12/2001 Rodrigues
6,332,815 B1 12/2001 Bruce
6,344,736 B1 2/2002 Kerrigan et al.
6,358,077 B1 3/2002 Young
6,375,866 B1 4/2002 Paneccasio et al.
6,390,825 B1 5/2002 Handley et al.
D458,904 S 6/2002 Montena
6,406,330 B2 6/2002 Bruce
D460,739 S 7/2002 Fox
D460,740 S 7/2002 Montena
D460,946 S 7/2002 Montena
D460,947 S 7/2002 Montena
D460,948 S 7/2002 Montena
6,416,847 B1 7/2002 Lein et al.
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,465,550 B1 10/2002 Kleyer et al.
6,468,100 B1 10/2002 Meyer et al.
6,478,618 B2 11/2002 Wong
6,491,546 B1 12/2002 Perry
D468,696 S 1/2003 Montena
6,506,083 B1 1/2003 Bickford et al.
6,530,807 B2 3/2003 Rodrigues et al.
6,540,531 B2 4/2003 Syed et al.
6,558,194 B2 5/2003 Montena
6,561,841 B2 5/2003 Norwood et al.
6,572,419 B2 6/2003 Feye-Homann
6,576,833 B2 6/2003 Covaro et al.
6,619,876 B2 9/2003 Vaitkus et al.
6,621,386 B2 9/2003 Drackner et al.
6,634,906 B1 10/2003 Yeh
6,674,012 B2 1/2004 Beele
6,676,446 B2 1/2004 Montena
6,683,253 B1 1/2004 Lee
6,692,285 B2 2/2004 Islam
6,692,286 B1 2/2004 De Cet
6,712,631 B1 3/2004 Youtsey
6,716,041 B2 4/2004 Ferderer et al.
6,716,062 B1 4/2004 Palinkas et al.
6,716,072 B1 4/2004 Downes
6,733,336 B1 5/2004 Montena et al.
6,733,337 B2 5/2004 Kodaira
6,767,248 B1 7/2004 Hung
6,769,926 B1 8/2004 Montena
6,780,052 B2 8/2004 Montena et al.
6,780,068 B2 8/2004 Bartholoma et al.
6,786,767 B1 9/2004 Fuks et al.
6,790,081 B2 9/2004 Burris et al.
6,805,584 B1 10/2004 Chen
6,817,896 B2 11/2004 Derenthal
6,830,479 B2 12/2004 Holliday
6,848,939 B2 2/2005 Stirling
6,848,940 B2 2/2005 Montena
6,884,113 B1 4/2005 Montena
6,884,115 B2 4/2005 Malloy
6,898,940 B2 5/2005 Gram et al.
6,910,910 B2 6/2005 Cairns
6,921,283 B2 7/2005 Zahlit et al.
6,929,265 B2 8/2005 Holland et al.
6,929,508 B1 8/2005 Holland
6,939,169 B2 9/2005 Islam et al.
6,971,912 B2 12/2005 Montena et al.
7,011,547 B1 3/2006 Wu
7,026,382 B2 4/2006 Akiba et al.
7,029,326 B2 4/2006 Montena
7,070,447 B1 7/2006 Montena
7,070,477 B2 7/2006 Morisawa et al.
7,086,897 B2 8/2006 Montena
7,097,499 B1 8/2006 Purdy
7,097,500 B2 8/2006 Montena
7,102,868 B2 9/2006 Montena
7,114,990 B2 10/2006 Bence et al.
7,118,416 B2 10/2006 Montena et al.
7,125,283 B1 10/2006 Lin
7,128,605 B2 10/2006 Montena
7,131,868 B2 11/2006 Montena
7,144,271 B1 12/2006 Burris et al.
7,147,509 B1 12/2006 Burris et al.
7,156,696 B1 1/2007 Montena
7,161,785 B2 1/2007 Chawgo
7,172,380 B2 2/2007 Lees et al.
7,172,381 B2 2/2007 Miyazaki
7,179,121 B1 2/2007 Burris et al.
7,186,127 B2 3/2007 Montena
7,189,097 B2 3/2007 Benham
7,192,308 B2 3/2007 Rodrigues et al.
7,207,820 B1 4/2007 Montena
7,229,303 B2 6/2007 Vermoesen et al.
7,252,546 B1 8/2007 Holland et al.
7,255,598 B2 8/2007 Montena et al.
7,264,503 B2 9/2007 Montena
7,299,520 B2 11/2007 Huang
7,299,550 B2 11/2007 Montena
7,300,309 B2 11/2007 Montena
7,354,309 B2 4/2008 Palinkas
7,371,112 B2 5/2008 Burris et al.
7,375,533 B2 5/2008 Gale
7,393,245 B2 7/2008 Palinkas et al.
7,402,063 B2 7/2008 Montena
7,404,737 B1 7/2008 Youtsey
7,452,237 B1 11/2008 Montena
7,452,239 B2 11/2008 Montena
7,455,550 B1 11/2008 Sykes
7,462,068 B2 12/2008 Amidon
7,473,128 B2 1/2009 Montena
7,476,127 B1 1/2009 Wei
7,479,035 B2 1/2009 Bence et al.
7,488,210 B1 2/2009 Burris et al.
7,494,355 B2 2/2009 Hughes et al.
7,497,729 B1 3/2009 Wei
7,500,874 B2 3/2009 Montena
7,507,117 B2 3/2009 Amidon
7,513,795 B1 4/2009 Shaw
7,544,094 B1 6/2009 Paglia et al.
7,544,097 B2 6/2009 Hong et al.
7,566,236 B2 7/2009 Malloy et al.
D597,959 S 8/2009 Malloy
7,568,945 B2 8/2009 Chee et al.
7,587,244 B2 9/2009 Olbertz
7,607,942 B1 10/2009 Van Swearingen
7,661,984 B2 2/2010 McMullen et al.
7,674,132 B1 3/2010 Chen
7,682,177 B2 3/2010 Berthet
7,727,011 B2 6/2010 Montena et al.
7,753,705 B2 * 7/2010 Montena ..... 439/277
7,753,727 B1 7/2010 Islam et al.
7,794,275 B2 9/2010 Rodrigues

| | | | | |
|---|---|---|---|---|
| 7,806,714 | B2 | 10/2010 | Williams et al. | |
| 7,806,725 | B1 | 10/2010 | Chen | |
| 7,811,133 | B2 | 10/2010 | Gray | |
| 7,824,216 | B2 | 11/2010 | Purdy | |
| 7,828,595 | B2 | 11/2010 | Mathews | |
| 7,828,596 | B2 | 11/2010 | Malak | |
| 7,830,154 | B2 | 11/2010 | Gale | |
| 7,833,053 | B2 | 11/2010 | Mathews | |
| 7,845,976 | B2 | 12/2010 | Mathews | |
| 7,845,978 | B1 | 12/2010 | Chen | |
| 7,850,487 | B1 | 12/2010 | Wei | |
| 7,857,661 | B1 | 12/2010 | Islam | |
| 7,874,870 | B1 | 1/2011 | Chen | |
| 7,887,354 | B2 | 2/2011 | Holliday | |
| 7,892,004 | B2 | 2/2011 | Hertzler et al. | |
| 7,892,005 | B2 | 2/2011 | Haube | |
| 7,892,024 | B1 * | 2/2011 | Chen | 439/578 |
| 7,927,135 | B1 | 4/2011 | Wlos | |
| 7,934,954 | B1 | 5/2011 | Chawgo et al. | |
| 7,950,958 | B2 | 5/2011 | Mathews | |
| 7,955,126 | B2 | 6/2011 | Bence et al. | |
| 7,972,158 | B2 | 7/2011 | Wild et al. | |
| 8,029,315 | B2 | 10/2011 | Purdy et al. | |
| 8,062,044 | B2 | 11/2011 | Montena et al. | |
| 8,062,063 | B2 * | 11/2011 | Malloy et al. | 439/578 |
| 8,071,174 | B2 | 12/2011 | Krenceski | |
| 8,075,337 | B2 | 12/2011 | Malloy et al. | |
| 8,075,338 | B1 | 12/2011 | Montena | |
| 8,079,860 | B1 | 12/2011 | Zraik | |
| 8,113,875 | B2 * | 2/2012 | Malloy et al. | 439/578 |
| 8,152,551 | B2 * | 4/2012 | Zraik | 439/322 |
| 8,157,588 | B1 | 4/2012 | Rodrigues et al. | |
| 8,157,589 | B2 | 4/2012 | Krenceski et al. | |
| 8,167,635 | B1 | 5/2012 | Mathews | |
| 8,167,636 | B1 | 5/2012 | Montena | |
| 8,167,646 | B1 | 5/2012 | Mathews | |
| 8,172,612 | B2 | 5/2012 | Bence et al. | |
| 8,192,237 | B2 | 6/2012 | Purdy et al. | |
| 8,231,412 | B2 | 7/2012 | Paglia et al. | |
| 8,241,060 | B2 | 8/2012 | Sykes | |
| 8,287,320 | B2 | 10/2012 | Purdy et al. | |
| 8,288,018 | B2 | 10/2012 | Abe et al. | |
| 8,313,345 | B2 | 11/2012 | Purdy | |
| 8,313,353 | B2 | 11/2012 | Purdy et al. | |
| 8,323,060 | B2 | 12/2012 | Purdy et al. | |
| 2002/0013088 | A1 | 1/2002 | Rodrigues et al. | |
| 2002/0038720 | A1 | 4/2002 | Kai et al. | |
| 2003/0068924 | A1 | 4/2003 | Montena | |
| 2003/0214370 | A1 | 11/2003 | Allison et al. | |
| 2003/0224657 | A1 | 12/2003 | Malloy | |
| 2004/0018312 | A1 | 1/2004 | Halladay | |
| 2004/0048514 | A1 | 3/2004 | Kodaira | |
| 2004/0077215 | A1 | 4/2004 | Palinkas et al. | |
| 2004/0102089 | A1 | 5/2004 | Chee | |
| 2004/0209516 | A1 | 10/2004 | Burris et al. | |
| 2004/0219833 | A1 | 11/2004 | Burris et al. | |
| 2004/0224552 | A1 | 11/2004 | Hagmann et al. | |
| 2004/0229504 | A1 | 11/2004 | Liu | |
| 2005/0042919 | A1 | 2/2005 | Montena | |
| 2005/0109994 | A1 | 5/2005 | Matheson et al. | |
| 2005/0164553 | A1 | 7/2005 | Montena | |
| 2005/0181652 | A1 | 8/2005 | Montena et al. | |
| 2005/0181668 | A1 | 8/2005 | Montena et al. | |
| 2005/0208827 | A1 | 9/2005 | Burris et al. | |
| 2005/0233636 | A1 | 10/2005 | Rodrigues et al. | |
| 2006/0081141 | A1 | 4/2006 | Deneka | |
| 2006/0099853 | A1 | 5/2006 | Sattele et al. | |
| 2006/0110977 | A1 | 5/2006 | Matthews | |
| 2006/0154519 | A1 | 7/2006 | Montena | |
| 2007/0026734 | A1 | 2/2007 | Bence et al. | |
| 2007/0049113 | A1 | 3/2007 | Rodrigues et al. | |
| 2007/0077360 | A1 | 4/2007 | Kashiwagi et al. | |
| 2007/0123101 | A1 | 5/2007 | Palinkas | |
| 2007/0155232 | A1 | 7/2007 | Burris et al. | |
| 2007/0175027 | A1 | 8/2007 | Khemakhem et al. | |
| 2007/0243759 | A1 | 10/2007 | Rodrigues et al. | |
| 2007/0243762 | A1 | 10/2007 | Burke et al. | |
| 2008/0102696 | A1 | 5/2008 | Montena | |
| 2008/0113554 | A1 | 5/2008 | Montena | |
| 2008/0289470 | A1 | 11/2008 | Aston | |
| 2008/0311790 | A1 | 12/2008 | Malloy et al. | |
| 2009/0029590 | A1 | 1/2009 | Sykes et al. | |
| 2009/0098770 | A1 | 4/2009 | Bence et al. | |
| 2009/0176396 | A1 | 7/2009 | Mathews | |
| 2009/0220794 | A1 | 9/2009 | O'Neill et al. | |
| 2010/0055978 | A1 | 3/2010 | Montena | |
| 2010/0081321 | A1 | 4/2010 | Malloy et al. | |
| 2010/0081322 | A1 | 4/2010 | Malloy et al. | |
| 2010/0105246 | A1 | 4/2010 | Burris et al. | |
| 2010/0233901 | A1 | 9/2010 | Wild et al. | |
| 2010/0233902 | A1 | 9/2010 | Youtsey | |
| 2010/0239871 | A1 | 9/2010 | Scheffer et al. | |
| 2010/0255720 | A1 | 10/2010 | Radzik et al. | |
| 2010/0255721 | A1 | 10/2010 | Purdy et al. | |
| 2010/0279548 | A1 | 11/2010 | Montena et al. | |
| 2010/0297871 | A1 | 11/2010 | Haube | |
| 2010/0297875 | A1 | 11/2010 | Purdy et al. | |
| 2011/0021072 | A1 | 1/2011 | Purdy | |
| 2011/0027039 | A1 | 2/2011 | Blair | |
| 2011/0053413 | A1 | 3/2011 | Mathews | |
| 2011/0111623 | A1 | 5/2011 | Burris et al. | |
| 2011/0117774 | A1 * | 5/2011 | Malloy et al. | 439/578 |
| 2011/0143567 | A1 | 6/2011 | Purdy et al. | |
| 2011/0200834 | A1 | 8/2011 | Krenceski | |
| 2011/0230089 | A1 | 9/2011 | Amidon et al. | |
| 2011/0230091 | A1 | 9/2011 | Krenceski et al. | |
| 2011/0232937 | A1 | 9/2011 | Montena et al. | |
| 2011/0279039 | A1 | 11/2011 | Kishimoto | |
| 2012/0021642 | A1 | 1/2012 | Zraik | |
| 2012/0094532 | A1 | 4/2012 | Montena | |
| 2012/0122329 | A1 | 5/2012 | Montena | |
| 2012/0145454 | A1 | 6/2012 | Montena | |
| 2012/0171894 | A1 | 7/2012 | Malloy et al. | |
| 2012/0196476 | A1 | 8/2012 | Haberek et al. | |
| 2012/0202378 | A1 | 8/2012 | Krenceski et al. | |
| 2012/0214342 | A1 | 8/2012 | Mathews | |
| 2012/0225581 | A1 | 9/2012 | Amidon et al. | |
| 2012/0252263 | A1 | 10/2012 | Ehret et al. | |
| 2012/0264332 | A1 | 10/2012 | Paglia et al. | |
| 2012/0270428 | A1 | 10/2012 | Purdy et al. | |
| 2012/0315788 | A1 | 12/2012 | Montena | |
| 2013/0034983 | A1 | 2/2013 | Purdy et al. | |

FOREIGN PATENT DOCUMENTS

| | | |
|---|---|---|
| CN | 201149937 | 11/2008 |
| CN | 201178228 | 1/2009 |
| DE | 47 931 | 10/1888 |
| DE | 1 02 289 | 7/1897 |
| DE | 11 17 687 | 11/1961 |
| DE | 11 91 880 | 12/1965 |
| DE | 15 15 398 | 4/1970 |
| DE | 22 21 936 | 11/1973 |
| DE | 22 61 973 | 6/1974 |
| DE | 22 25 764 | 12/1974 |
| DE | 32 11 008 | 10/1983 |
| DE | 90 01 608 | 4/1990 |
| DE | 41 28 551 | 3/1992 |
| DE | 44 39 852 | 5/1996 |
| DE | 199 57 518 | 9/2001 |
| EP | 0 167 738 | 1/1985 |
| EP | 0 721 04 | 1/1986 |
| EP | 0 116 157 | 10/1986 |
| EP | 0 265 276 | 4/1988 |
| EP | 0 428 424 | 5/1991 |
| EP | 1 191 268 | 3/2002 |
| EP | 1 501 159 | 1/2005 |
| EP | 1 548 898 | 6/2005 |
| EP | 1 701 410 | 9/2006 |
| FR | 2232846 | 6/1974 |
| FR | 2234680 | 1/1975 |
| FR | 2312918 | 12/1976 |
| FR | 2462798 | 2/1981 |
| FR | 2494508 | 5/1982 |
| FR | 2524722 | 10/1983 |
| GB | 0 589 697 | 6/1947 |
| GB | 1 087 228 | 10/1967 |
| GB | 1 270 846 | 4/1972 |
| GB | 1 401 373 | 7/1975 |

| | | |
|---|---|---|
| GB | 2 019 665 | 10/1979 |
| GB | 2 079 549 | 7/1981 |
| GB | 2 252 677 | 8/1992 |
| GB | 2 264 201 | 8/1993 |
| GB | 2 331 634 | 5/1999 |
| JP | 03-280369 | 3/1990 |
| JP | 3071571 | 3/1991 |
| JP | 3280369 | 12/1991 |
| JP | 10-228948 | 8/1998 |
| JP | 4503793 | 1/2002 |
| JP | 2002-075556 | 3/2002 |
| JP | 2004-176005 | 6/2004 |
| KR | 100622526 | 9/2006 |
| TW | 427044 | 3/2001 |
| WO | WO-87/00351 | 1/1987 |
| WO | WO-93/24973 | 12/1993 |
| WO | WO-96/08854 | 3/1996 |
| WO | WO-01/86756 | 11/2001 |
| WO | WO-02/069457 | 9/2002 |
| WO | WO-2004/013883 | 2/2004 |
| WO | WO-2006/081141 | 8/2006 |
| WO | WO-2008/066995 | 6/2008 |
| WO | WO-2010/054021 | 5/2010 |
| WO | WO-2010/054026 | 5/2010 |
| WO | WO-2011/128665 | 10/2011 |
| WO | WO-2011/128666 | 10/2011 |
| WO | WO-2012/061379 | 5/2012 |

OTHER PUBLICATIONS

Notice of Allowance for U.S. Appl. No. 12/568,160, mail date Jul. 8, 2011, 5 pages.
Notice of Allowance for U.S. Appl. No. 12/568,179, mail date Aug. 9, 2011, 5 pages.
Notice of Allowance for U.S. Appl. No. 12/568,160, mail date Apr. 18, 2011, 8 pages.
Notice of Allowance for U.S. Appl. No. 12/568,179, mail date Mar. 21, 2011, 10 pages.
Office Action for U.S. Appl. No. 12/568,149, mail date May 12, 2011, 8 pages.
Office Action for U.S. Appl. No. 12/568,160, mail date Jul. 22, 2010, 9 pages.
Office Action for U.S. Appl. No. 12/568,160, mail date Sep. 8, 2010, 10 pages.
Response to Office Action for U.S. Appl. No. 12/568,160, filed Aug. 23, 2010, 3 pages.
Response to Office Action for U.S. Appl. No. 12/568,160, filed Mar. 7, 2011, 37 pages.
Statement of Substance of Interview, Terminal Disclaimer and Statement Under 37 CFR 3.73(b) for U.S. Appl. No. 12/568,179, filed Jun. 30, 2011, 5 pages.
U.S. Appl. No. 13/652,073.
U.S. Appl. No. 13/652,124.
U.S. Appl. No. 61/180,835, filed May 22, 2009, Eric Purdy.
U.S. Appl. No. 61/554,572.
Digicon AVL Connector, Arris Group Inc., http://www.arrisi.com/special/digiconAVL.asp, retrieved on Apr. 22, 2010, 3 pages.
EP Appl. No. EP05813878.5-2214/Patent No. 1815559. Response to Supplementary European Search Report dated Feb. 6, 2009. Response date Dec. 10, 2009. 15 pages.
EP Appl. No. EP05813878.5-2214/Patent No. 1815559. Summons to Attend Oral Proceedings Pursuant to Rule 115(1) EPC on Oct. 28, 2010. Dated: Jun. 7, 2010. 12 pages.
Final Office Action (Mail Date: Oct. 25, 2011); U.S. Appl. No. 13/033,127, filed Feb. 23, 2011, Conf. No. 8230.
International Search Report and Written Opinion for PCT Application No. PCT/US2012/045669, mailed Jan. 21, 2013, 9 pages.
International Search Report and Written Opinion for PCT/US12/23528, mailed Jun. 1, 2012, 10 pages.
John Mezzalingua Associates, Inc. v. PCT International, Inc.; U.S. District Court Western District of Texas (San Antonio); Civil Docket for Case #: 5:09-cv-00410-WRF. No decision yet. Defendant/Counterclaimant PCT International, Inc.'s First Supplemental Answers and Objections to Plaintiff/Counterclaimant Defendant John Mezzalingua Associates, Inc. D/B/AS PPC's Amended Second Set of Interrogatories (Nos. 4-17). pp. 1-11.
John Mezzalingua Associates, Inc. v. PCT International, Inc.; U.S. District Court Western District of Texas (San Antonio); Civil Docket for Case #: 5:09-cv-00410-WRF. No decision yet. Defendant's Answer to Plaintif's First Amended Complaint, Affirmative Defenses and Counterclaims. pp. 1-53.
John Mezzalingua Associates, Inc. v. PCT International, Inc.; U.S. District Court Western District of Texas (San Antonio); Civil Docket for Case #: 5:09-cv-00410-WRF. No decision yet. Defendant's Response and Objections to Plaintaff's Amended Second Set of Interrogatories (Nos. 4-17). pp. 1-20.
John Mezzalingua Associates, Inc. v. PCT International, Inc.; U.S. District Court Western District of Texas (San Antonio); Civil Docket for Case #: 5:09-cv-00410-WRF. No decision yet. Expert Report of Barry Grossman (Redacted). 61 pages.
Notice of Allowance (Date Mailed: Aug. 5, 2011) for U.S. Appl. No. 12/418,103 filed Apr. 3, 2009.
Notice of Allowance (Date Mailed: Feb. 24, 2012) for U.S. Appl. No. 13/033,127 filed Feb. 23, 2011.
Notice of Allowance U.S. Appl. No. 12/397,087; Filing date Mar. 3, 2009.
Notice of Allowance U.S. Appl. No. 12/414,159; Filing date Mar. 30, 2009.
Notice of Allowance U.S. Appl. No. 12/427,843; Filing date Apr. 22, 2009.
Office Action (Mail Date Jun. 2, 2011) for U.S. Appl. No. 13/033,127, filed Feb. 23, 2011, Conf. No. 8230.
Office Action (Mail Date: Oct. 24, 2011); U.S. Appl. No. 12/633,792, filed Dec. 8, 2009.
PCT International, Inc. v. John Mezzalingua Associates, Inc.; U.S. District Court District of Delaware (Wilmington); Civil Docket for Case #: 1:10-cv-00059-LPS. No decision yet.
PCT/US2010/029587; International Filing Date Apr. 1, 2010. International Search Report and Written Opinion. Date of Mailing: Oct. 29, 2010.
PCT/US2010/029593; International Filing Date Apr. 1, 2010; International Search Report and Written Opinion; Date of Mailing: Nov. 12, 2010.
PCT/US2010/034870; International Filing Date May 14, 2010. International Search Report and Written Opinion. Date of Mailing: Nov. 30, 2010.
Supplemental European Search Report. EP05813878. Feb. 6, 2009. 11 pages.

* cited by examiner

FIG. 10A
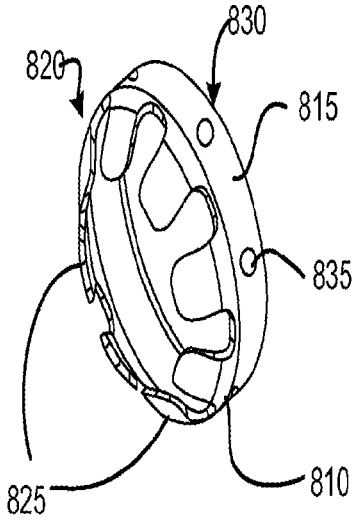
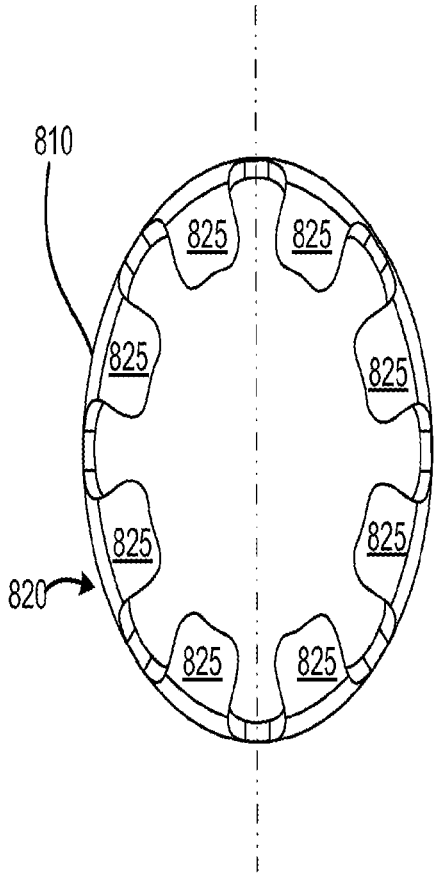
FIG. 10B

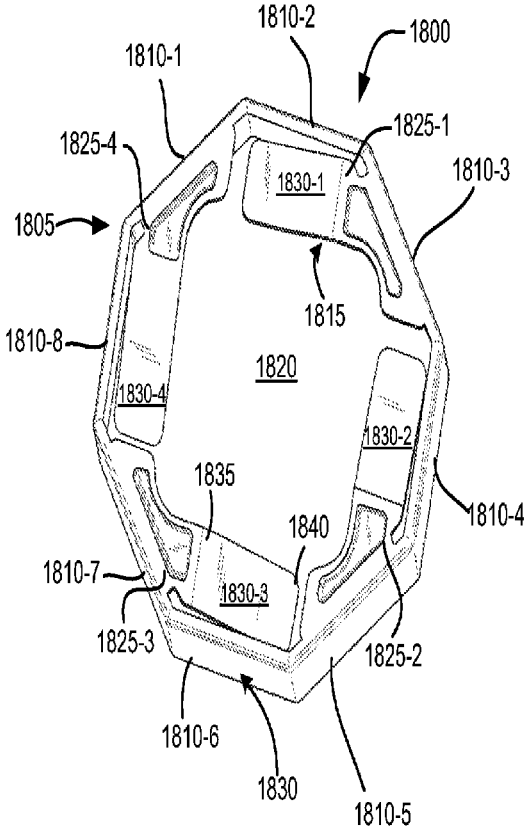
FIG. 18
FIG. 19
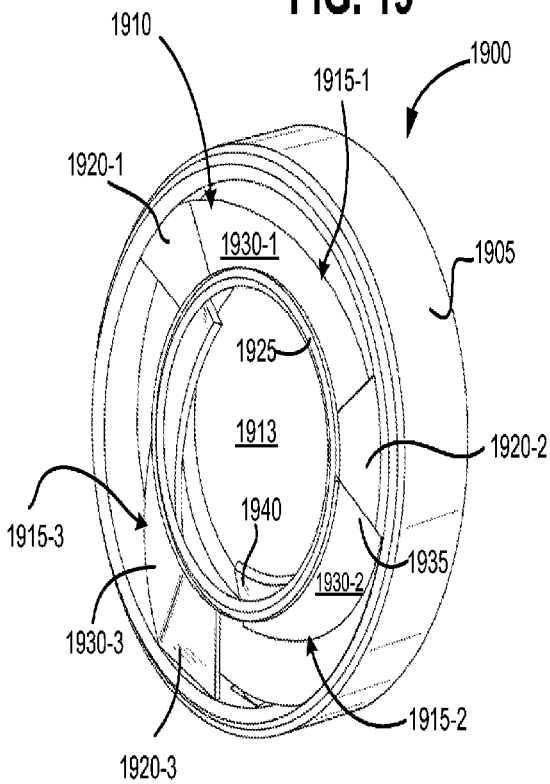

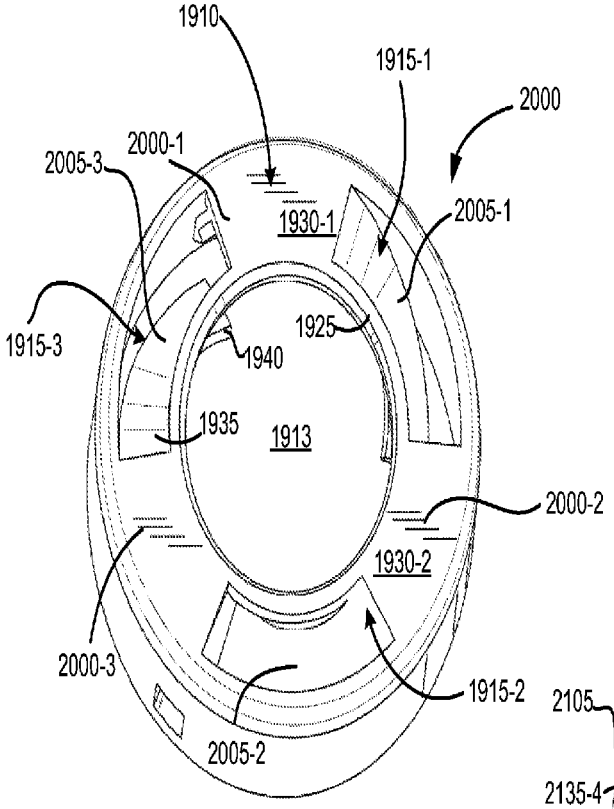
FIG. 20
FIG. 21
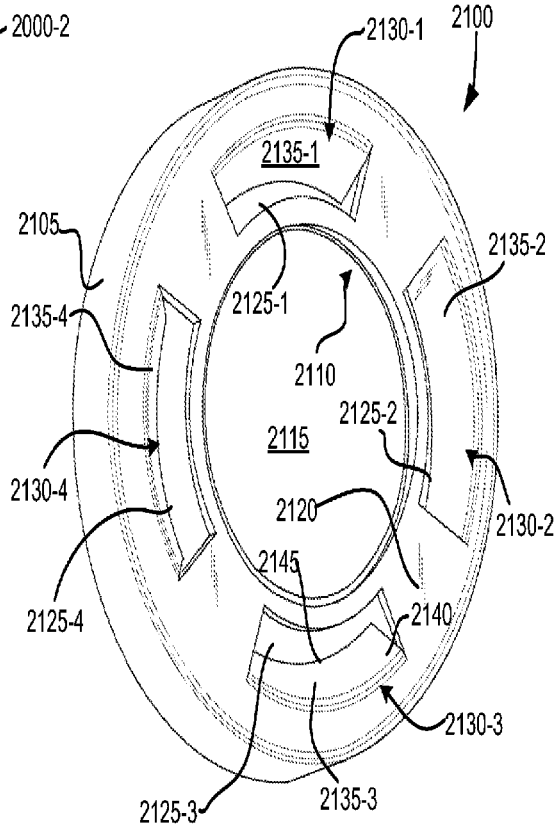

CABLE CONNECTOR HAVING A BIASING ELEMENT

CROSS-REFERENCE TO RELATED APPLICATIONS

This application is a continuation of U.S. application Ser. No. 12/568,160, filed Sep. 28, 2009, which claims priority under 35 U.S.C. §119, based on U.S. Provisional Patent Application Nos. 61/101,185, filed Sep. 30, 2008; 61/101,191, filed Sep. 30, 2008; 61/155,246, filed Feb. 25, 2009; 61/155,249, filed Feb. 25, 2009; 61/155,250, filed Feb. 25, 2009; 61/155,252, filed Feb. 25, 2009; 61/155,289, filed Feb. 25, 2009; 61/155,297, filed Feb. 25, 2009; 61/175,613, filed May 5, 2009; and 61/242,884, filed Sep. 16, 2009, the disclosures of which are all hereby incorporated by reference herein.

The present application is also related to co-pending U.S. patent application Ser. Nos. 12/568,149, entitled "Cable Connector,", filed Sep. 28, 2009, and U.S. patent application Ser. No. 12/568,179, entitled "Cable Connector,"filed Sep. 28, 2009, the disclosures of which are both hereby incorporated by reference herein.

BACKGROUND OF THE INVENTION

Connectors are used to connect coaxial cables to various electronic devices, such as televisions, antennas, set-top boxes, satellite television receivers, etc. Conventional coaxial connectors generally include a connector body having an annular collar for accommodating a coaxial cable, an annular nut rotatably coupled to the collar for providing mechanical attachment of the connector to an external device, and an annular post interposed between the collar and the nut. The annular collar that receives the coaxial cable includes a cable receiving end for insertably receiving a coaxial cable and, at the opposite end of the connector body, the annular nut includes an internally threaded end that permits screw threaded attachment of the body to an external device.

This type of coaxial connector also typically includes a locking sleeve to secure the cable within the body of the coaxial connector. The locking sleeve, which is typically formed of a resilient plastic material, is securable to the connector body to secure the coaxial connector thereto. In this regard, the connector body typically includes some form of structure to cooperatively engage the locking sleeve. Such structure may include one or more recesses or detents formed on an inner annular surface of the connector body, which engages cooperating structure formed on an outer surface of the sleeve.

Conventional coaxial cables typically include a center conductor surrounded by an insulator. A conductive foil is disposed over the insulator and a braided conductive shield surrounds the foil-covered insulator. An outer insulative jacket surrounds the shield. In order to prepare the coaxial cable for termination with a connector, the outer jacket is stripped back exposing a portion of the braided conductive shield. The exposed braided conductive shield is folded back over the jacket. A portion of the insulator covered by the conductive foil extends outwardly from the jacket and a portion of the center conductor extends outwardly from within the insulator.

Upon assembly, a coaxial cable is inserted into the cable receiving end of the connector body and the annular post is forced between the foil covered insulator and the conductive shield of the cable. In this regard, the post is typically provided with a radially enlarged barb to facilitate expansion of the cable jacket. The locking sleeve is then moved axially into the connector body to clamp the cable jacket against the post barb providing both cable retention and a water-tight seal around the cable jacket. The connector can then be attached to an external device by tightening the internally threaded nut to an externally threaded terminal or port of the external device.

The Society of Cable Telecommunication Engineers (SCTE) provides values for the amount of torque recommended for connecting such coaxial cable connectors to various external devices. Indeed, most cable television (CATV), multiple systems operator (MSO), satellite and telecommunication providers also require their installers to apply a torque requirement of 25 to 30 in/lb to secure the fittings against the interface (reference plane). The torque requirement prevents loss of signals (egress) or introduction of unwanted signals (ingress) between the two mating surfaces of the male and female connectors, known in the field as the reference plane.

BRIEF DESCRIPTION OF THE DRAWINGS

FIG. 10A is an enlarged, isometric view of the exemplary biasing element of FIGS. 8 and 9;

FIG. 10B is an enlarged axial view of the biasing element of FIG. 10A taken along line A of FIG. 8;

FIGS. 17-22 are isometric illustrations of alternative implementations of biasing element for use with the coaxial cable connector of FIG. 1;

DETAILED DESCRIPTION OF THE PREFERRED EMBODIMENTS

A large number of home coaxial cable installations are often done by "do-it yourself" laypersons who may not be familiar with torque standards associated with cable connectors. In these cases, the installer will typically hand-tighten the coaxial cable connectors instead of using a tool, which can result in the connectors not being properly seated, either upon initial installation, or after a period of use. Upon immediately receiving a poor signal, the customer typically calls the CATV, MSO, satellite or telecommunication provider to request repair service. Obviously, this is a cost concern for the CATV, MSO, satellite and telecommunication providers, who then have to send a repair technician to the customer's home.

Moreover, even when tightened according to the proper torque requirements, another problem with such prior art connectors is the connector's tendency over time to become disconnected from the external device to which it is connected, due to forces such as vibrations, heat expansion, etc. Specifically, the internally threaded nut for providing mechanical attachment of the connector to an external device has a tendency to back-off or loosen itself from the threaded port connection of the external device over time. Once the connector becomes sufficiently loosened, electrical connection between the coaxial cable and the external device is broken, resulting in a failed condition.

Figure 1:
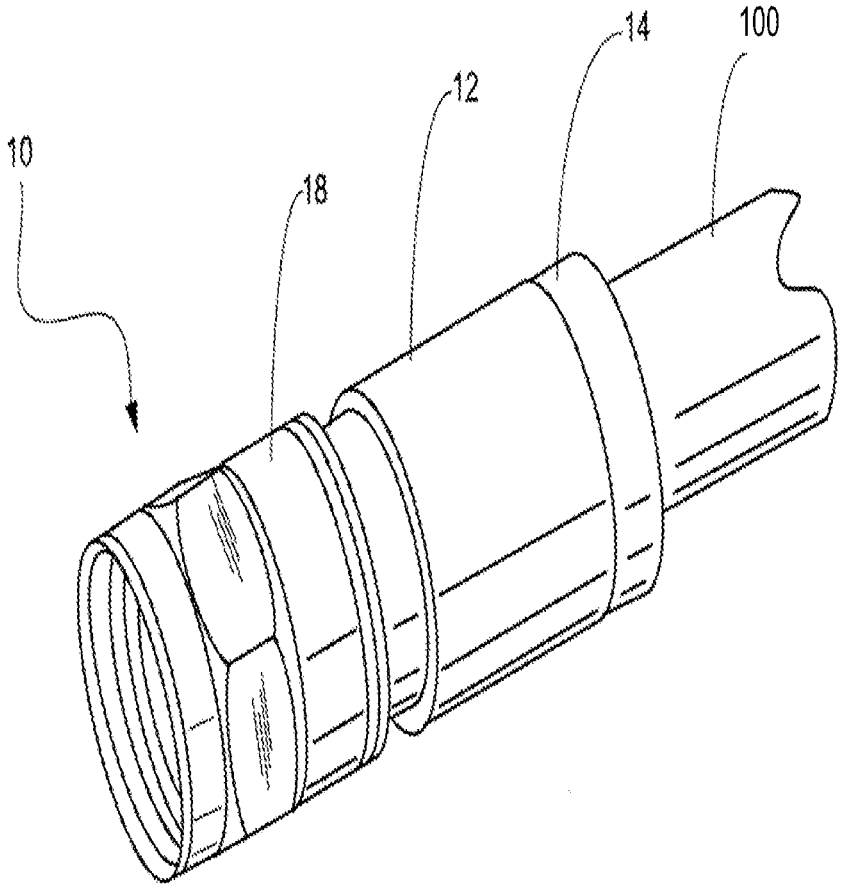
FIG. 1 is an isometric view of an exemplary embodiment of a coaxial cable connector.
Figure 2:
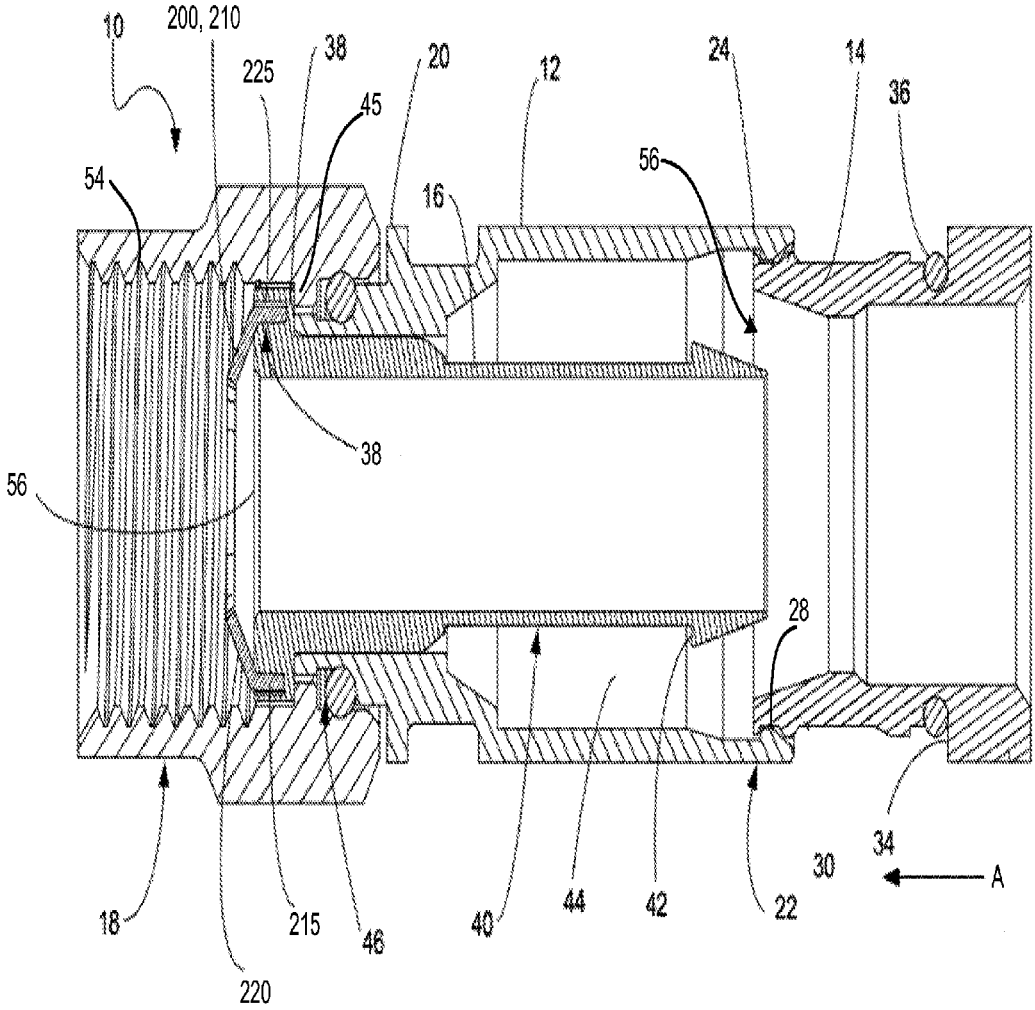
FIG. 2 is a cross-sectional view of an exemplary embodiment of the coaxial cable connector of the FIG. 1.

FIGS. 1-2 depict an exemplary coaxial cable connector 10 consistent with embodiments described herein. As illustrated in FIG. 1, connector 10 may include a connector body 12, a locking sleeve 14, an annular post 16, and a rotatable nut 18.

In one implementation, connector body 12 (also referred to as a "collar") may include an elongated, cylindrical member, which can be made from plastic, metal, or any suitable material or combination of materials. Connector body 12 may include a forward end 20 operatively coupled to annular post 16 and rotatable nut 18, and a cable receiving end 22 opposite to forward end 20. Cable receiving end 22 may be configured to insertably receive locking sleeve 14, as well as a prepared end of a coaxial cable 100 in the forward direction as shown by arrow A in FIG. 2. Cable receiving end 22 of connector body 12 may further include an inner sleeve engagement surface 24 for coupling with the locking sleeve 14. In some implementations, inner sleeve engagement surface 24 is preferably formed with a groove or recess 26, which cooperates with mating detent structure 28 provided on the outer surface of locking sleeve 14.

Locking sleeve 14 may include a substantially tubular body having a rearward cable receiving end 30 and an opposite forward connector insertion end 32, movably coupled to inner sleeve engagement surface 24 of the connector body 12. As mentioned above, the outer cylindrical surface of locking sleeve 14 may be configured to include a plurality of ridges or projections 28, which cooperate with groove or recess 26 formed in inner sleeve engagement surface 24 of the connector body 12 to allow for the movable connection of sleeve 14 to the connector body 12, such that locking sleeve 14 is lockingly axially moveable along the direction of arrow A toward the forward end 20 of the connector body 12 from a first position, as shown, for example, in FIG. 2 to a second, axially advanced position (shown in FIG. 1). When in the first position, locking sleeve 14 may be loosely retained in connector 10. When in the second position, locking sleeve 14 may be secured within connector 10. In some implementations, locking sleeve 14 may be detachably removed from connector 10, e.g., during shipment, etc., by, for example, snappingly removing projections 28 from groove/recess 26. Prior to installation, locking sleeve 14 may be reattached to connector body 12 in the manner described above.

In some additional implementations, locking sleeve 14 may include a flanged head portion 34 disposed at the rearward cable receiving end 30 of locking sleeve 14. Head portion 34 may include an outer diameter larger than an inner diameter of the body 12 and may further include a forward facing perpendicular wall 36, which serves as an abutment surface against which the rearward end 22 of body 12 stops to prevent further insertion of locking sleeve 14 into body 12. A resilient, sealing O-ring 37 may be provided at forward facing perpendicular wall 36 to provide a substantially water-tight seal between locking sleeve 14 and connector body 12 upon insertion of the locking sleeve within the body and advancement from the first position (FIG. 2) to the second position (FIG. 1).

As mentioned above, connector 10 may further include annular post 16 coupled to forward end 20 of connector body 12. As illustrated in FIG. 2, annular post 16 may include a flanged base portion 38 at its forward end for securing the post within annular nut 18. Annular post 16 may also include an annular tubular extension 40 extending rearwardly within body 12 and terminating adjacent rearward end 22 of connector body 12. In one embodiment, the rearward end of tubular extension 40 may include a radially outwardly extending ramped flange portion or "barb" 42 to enhance compression of the outer jacket of the coaxial cable and to secure the cable within connector 10. Tubular extension 40 of annular post 16, locking sleeve 14, and connector body 12 together define an annular chamber 44 for accommodating the jacket and shield of an inserted coaxial cable.

As illustrated in FIGS. 1 and 2, annular nut 18 may be rotatably coupled to forward end 20 of connector body 12. Annular nut 18 may include any number of attaching mechanisms, such as that of a hex nut, a knurled nut, a wing nut, or any other known attaching means, and may be rotatably coupled to connector body 12 for providing mechanical attachment of the connector 10 to an external device via a threaded relationship. As illustrated in FIG. 2, nut 18 may include an annular flange 45 configured to fix nut 18 axially relative to annular post 16 and connector body 12. In one implementation, a resilient sealing O-ring 46 may be positioned in annular nut 18 to provide a water resistant seal between connector body 12, annular post 16, and annular nut 18

Connector 10 may be supplied in the assembled condition, as shown in the drawings, in which locking sleeve 14 is pre-installed inside rearward cable receiving end 22 of connector body 12. In such an assembled condition, a coaxial cable may be inserted through rearward cable receiving end 30 of locking sleeve 14 to engage annular post 16 of connector 10 in the manner described above. In other implementations, locking sleeve 14 may be first slipped over the end of a coaxial cable and the cable (together with locking sleeve 14) may subsequently be inserted into rearward end 22 of connector body 12.

In either case, once the prepared end of a coaxial cable is inserted into connector body 12 so that the cable jacket is separated from the insulator by the sharp edge of annular post 16, locking sleeve 14 may be moved axially forward in the direction of arrow A from the first position (shown in FIG. 2) to the second position (shown in FIG. 1). In some implementations, advancing locking sleeve 14 from the first position to the second position may be accomplished with a suitable compression tool. As locking sleeve 14 is moved axially forward, the cable jacket is compressed within annular chamber 44 to secure the cable in connector 10. Once the cable is secured, connector 10 is ready for attachment to a port connector 48 (illustrated in FIGS. 9 and 15B), such as an F-81 connector, of an external device.

As illustrated below in relation to FIGS. 9 and 15B, port connector 48 may include a substantially cylindrical body 50 having external threads 52 that match internal threads 54 of annular nut 18. As will be discussed in additional detail below, retention force between annular nut 18 and port connector 48 may be enhanced by providing a substantially constant load force on the port connector 48.

As illustrated in FIG. 2, in an exemplary implementation, connector 10 may include a biasing element or spring 200 extending outwardly beyond a forward face 56 of shoulder portion 38 of the post 16 for making resilient contact with a rearward face (element 58 in FIG. 9) of a mating connector port. Biasing element 200 may include a degree of flexure in that it is designed to deflect or deform in a rearward direction back toward forward face 56 of post shoulder portion 38. Thus, when nut 18 is tightened on a mating connector port, biasing element 200 is forced to compress to a certain degree as the rearward face of the connector port makes contact with the biasing element. Such compression, or rearward deflection is desirable so that, should nut 18 loosen and the rearward face of the mating connector port begin to back away from forward face 56 of the post, the resilience of biasing element 200 will urge biasing element 200 to spring back to its initial form so that biasing element 200 will maintain contact with rearward face 58 of the mating connector port 48.

Figure 3:
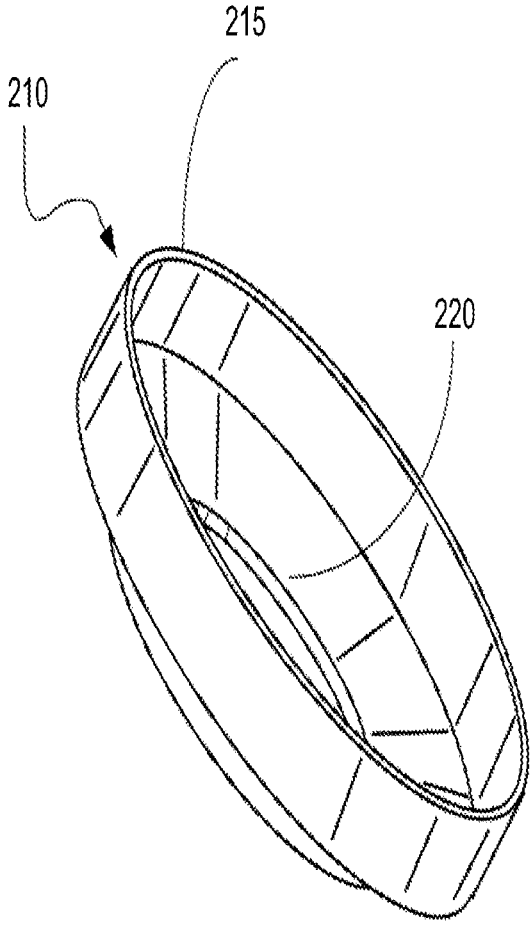
FIG. 3 is a perspective view of the biasing element of the connector shown in FIG. 1.
Figure 4:
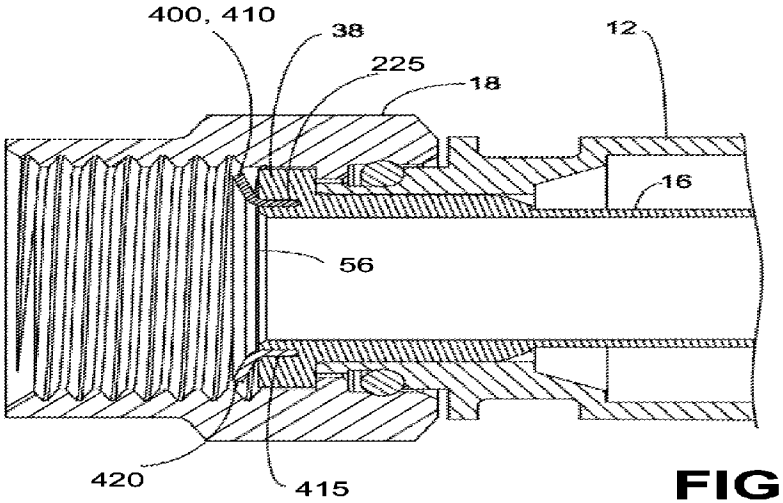
FIG. 4 is cross-sectional view of an alternative embodiment of the coaxial cable connector of the present invention.

Biasing element 200 can take various forms, but in each form biasing element 200 is preferably made from a durable, resilient electrically conductive material, such as spring steel, for transferring the electrical signal from post shoulder portion 38 to rearward face 58 of mating connector port 48. In the embodiment shown in FIGS. 2 and 3, biasing element 200 is in the form of a ring 210 having a cylindrical base portion 215 and a deflectable skirt portion 220 extending in a forward direction from a forward end of base portion 215. As shown, deflectable skirt portion 220 extends in a direction radially inward from base portion 215, while the ring 410 shown in FIGS. 4 and 5 has a deflectable skirt portion 420 that extends in a direction radially outward from the base portion 415.

In both embodiments described above, base portion 215/415 of the ring 210/410 is preferably press-fit within a circular groove 225 formed directly in forward face 56 of the post shoulder portion 38. Also in both embodiments, with ring 210/410 fixed to the post shoulder portion 38, deflectable skirt 220/420 may extend beyond forward face 56 of the post shoulder portion 38 a distance in the forward direction and is permitted to deflect or deform with respect to fixed base portion 215 toward and away from post forward face 56.

Figure 6A:
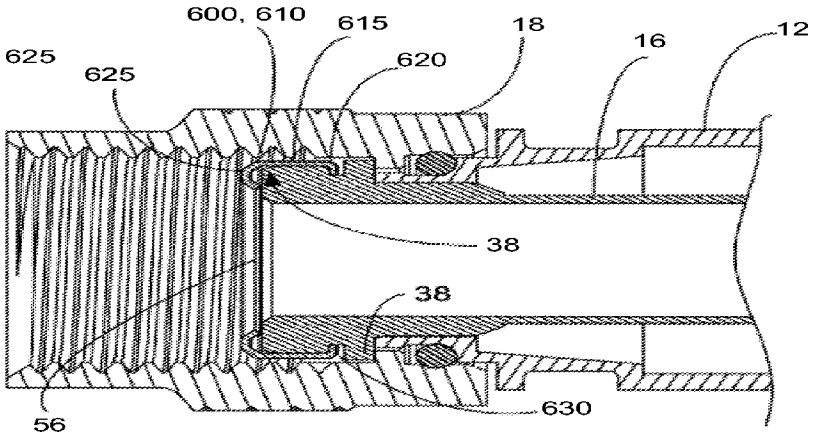
FIG. 6A is a cross-sectional view of another alternative embodiment of the coaxial cable connector of the present invention.
Figure 6B:
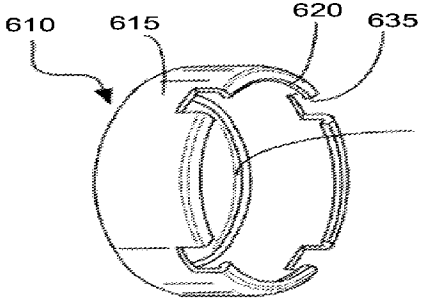
FIG. 6B is a perspective view of the biasing element shown in FIG. 6A.

In an alternative embodiment, as shown in FIGS. 6A and 6B, connector 10 may include a biasing element or spring 600 formed as a ring 610 having a cylindrical wall 615 with a retaining lip 620 formed on a rearward end of the wall and a reverse-bent, deflectable rim 625 formed on a forward end of the wall opposite the retaining lip. Cylindrical wall 615 may include an inner diameter closely matching an outer diameter of post shoulder portion 38 and retaining lip 620 may extend in a direction radially inward from cylindrical wall 615. Retaining lip 620 may be received in a peripheral groove 630 formed in the outer diametric surface of post shoulder portion 38. To facilitate assembly, retaining lip 620 can be formed with one or more slots 635 that enhance flexure of lip 620 to permit easy snap-fit insertion of post shoulder portion 38 within ring 610.

Like the deflectable skirts 220/420 described above, the deflectable rim 625 of FIG. 6 may extend beyond forward face 56 of the post shoulder portion a distance in the forward direction and is permitted to deflect or deform with respect to the cylindrical wall 615. In this case, the reverse-bent geometry of deflectable rim 625 allows the rim to collapse on itself when subjected to compression and return to its original shape as the compressive force is removed. Thus, the forward-most portion of rim 625 is permitted to move toward and away from post forward face 56.

Figure 7A:
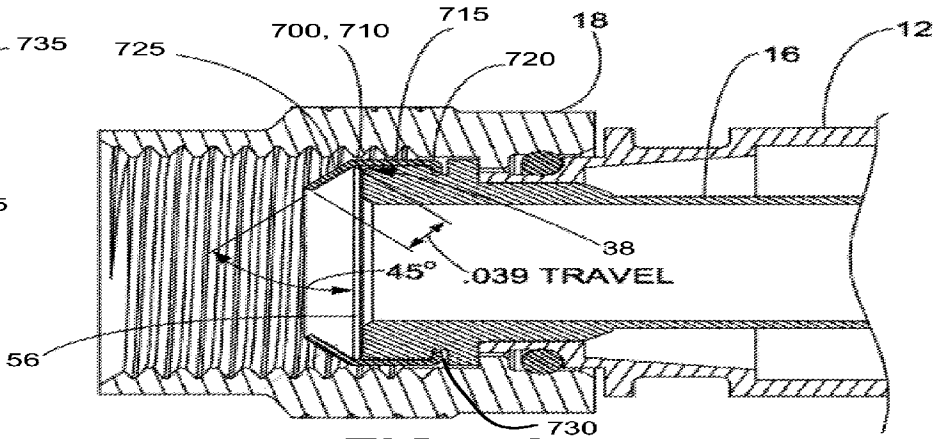
FIG. 7A is a cross-sectional view of still another alternative embodiment of the coaxial cable connector of the present invention.
Figure 7B:
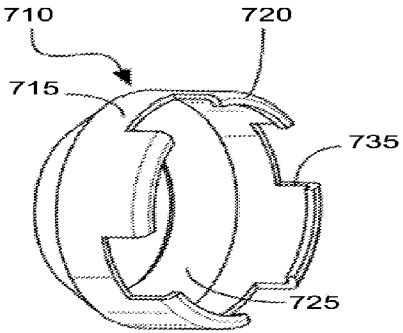
FIG. 7B is a perspective view of the biasing element shown in FIG. 7A.
Figure 8:
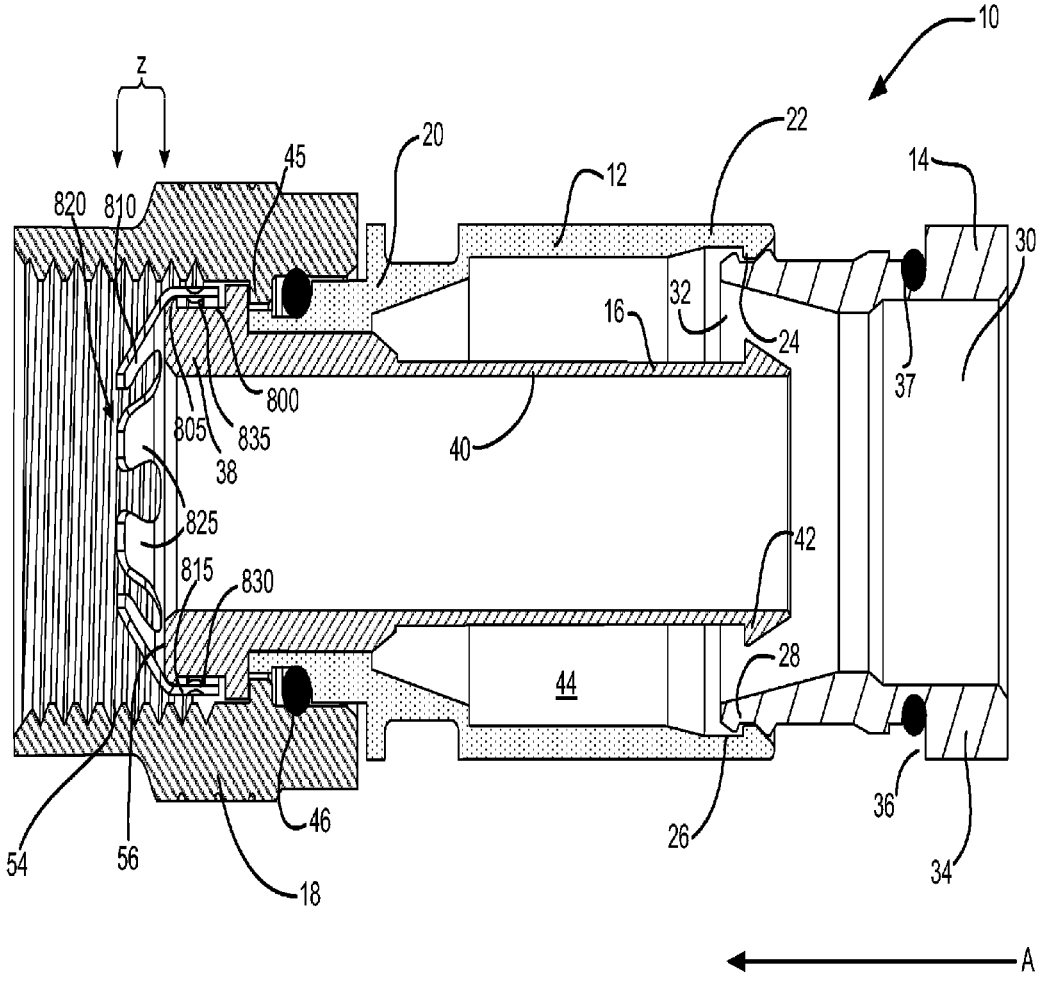
FIG. 8 is a cross-sectional view of another exemplary embodiment of the coaxial cable connector of FIG. 1 in an unconnected configuration.

In another alternative embodiment, as shown in FIGS. 7A and 7B, connector 10 may include a biasing element or spring 700 formed as a ring 710 having a combination of the features of the rings 210, 410, and 610 described above. Specifically, the ring 710 may include a cylindrical wall 715 with a retaining lip 720 formed on a rearward end of wall 715 similar to the ring 610 described above. However, in this case, a deflectable skirt 725 may be formed on the forward end of the wall opposite retaining lip 720. Again, cylindrical wall 715 may include an inner diameter closely matching the outer diameter of post shoulder portion 38 and retaining lip 720 may extend in a direction radially inward from cylindrical wall 715. Retaining lip 720 may be received in a peripheral groove 730 formed in the outer diametric surface of the post shoulder portion 38. To facilitate assembly, retaining lip 720 can again be formed with one or more slots 735 that enhance flexure of lip 720 to permit easy snap-fit insertion of the post shoulder portion 38 within the ring 710.

Like the deflectable skirt 220 described above, deflectable skirt 725 of ring 710 may extend in a forward direction from a forward end of cylindrical wall 715 and may also extend in a direction radially inward from cylindrical wall 715. In one implementation, deflectable skirt 725 may project at an angle of approximately 45 degrees relative to forward surface 56 of annular post 16. Furthermore, deflectable skirt 725 may project approximately 0.039 inches from the forward edge of ring 710. When snap-fit over the post shoulder portion 38, deflectable skirt 725 may extend beyond the forward face 56 of post shoulder portion 38 a distance in the forward direction and is permitted to deflect or deform with respect to the cylindrical wall 715 toward and away from post forward face 56.

By providing a biasing element 200/400/600/700 on forward face 56 of post shoulder portion 38, connector 10 may allows for up to 360 degree "back-off" rotation of the nut 18 on a terminal, without signal loss. In other words, the biasing element may help to maintain electrical continuity even if the nut is partially loosened. As a result, maintaining electrical contact between coaxial cable connector 10 and the signal contact of port connector 48 is improved by a factor of 400-500%, as compared with prior art connectors.

Referring now to FIGS. 8-10B, another alternative implementation of a connector 10 is illustrated. The embodiment of FIGS. 8-10B is similar to the embodiment illustrated in FIG. 2, and similar reference numbers are used where appropriate. In the embodiment of FIGS. 8-10B, retention force between annular nut 18 and port connector 48 may be enhanced by providing a substantially constant load force on the port connector 48. To provide this load force, flanged base portion 38 of annular post 16 may be configured to include a notched configuration that includes an annular notch portion 800 and an outwardly extending lip portion 805, with annular notch portion 800 having a smaller outside diameter than lip portion 805. Annular notch portion 800 may be configured to retain a biasing element 810. In one implementation, the outside diameter of a forward surface of lip portion 805 may beveled, chamfered, or otherwise angled, such that a forwardmost portion of lip portion 805 has a smaller inside diameter than a readwardmost portion of lip portion 805. For example, forwardmost portion of lip portion 805 may include an outside 25° radius curve. Other suitable degrees of curvature may be used. Such a configuration may enable efficient assembly of biasing element 810 with annular post 16, as described in additional detail below. In addition, in some implementations, biasing element 810 may include an inside 25° radius curve to match the outside curve on lip portion 805.

Biasing element 810 may include a conductive, resilient element configured to provide a suitable biasing force between annular post 16 and rearward surface 58 of port connector 48. The conductive nature of biasing element 810 may facilitate passage of electrical and radio frequency (RF) signals from annular post 16 to port connector 48 at varying degrees of insertion relative to port connector 48 and connector 10.

In one implementation, biasing element 810 may include a conical spring having first, substantially cylindrical attachment portion 815 configured to engagingly surround at least a portion of flanged base portion 38, and a second portion 820 having a number of slotted resilient fingers 825 configured in a substantially conical manner with respect to first portion 815. As illustrated in FIGS. 10A and 10B, a forward end of second portion 820 may have a smaller diameter than the diameter of rearward end of second portion 820 and first portion 815. As described above, in one implementation, first portion 815 and second portion 820 may transition via an inside curve that substantially matches an outside curve of lip portion 805. By providing substantially matching inside and outside curves, over stressing of the bending moment of biasing element 810 may be reduced.

In one exemplary embodiment, resilient fingers 825 may be equally spaced around a circumference of biasing element 810, such that biasing element 810 includes eight resilient fingers 825, with a centerline of each finger 825 being positioned approximately 45° from its adjacent fingers 825. The number of resilient fingers 825 illustrated in FIGS. 10A and 10B is exemplary and any suitable number of resilient fingers 825 may be used in a manner consistent with implementations described herein.

First portion 815 of biasing element 810 may be configured to have an inside diameter substantially equal to the outside diameter of lip portion 805. First portion 815 may be further configured to include a number of attachment elements 830 designed to engage notch portion 800 of flanged base portion 38. As illustrated in FIGS. 10A and 10B, in one exemplary implementation, attachment elements 830 may include a number of dimples or detents 835 formed in first portion 815, such that an interior of each detent 835 projects within the interior diameter of first portion 815. Detents 835 may be referred to as "lantzes" or "bump lantzes" and may be formed by forcefully applying a suitably shaped tool, such as an awl, hammer, etc., to the outside diameter of first portion 815. In one exemplary implementation, first portion 815 may include eight detents 835 formed around a periphery of first portion 815. In another exemplary implementation (not shown), a single continuous detent may be formed around the periphery of first portion 815 to engage notch portion 800.

In one embodiment, biasing element 810 may be formed of a metallic material, such as spring steel, having a thickness of approximately 0.008 inches. In other implementations, biasing element 810 may be formed of a resilient, elastomeric, rubber, or plastic material, impregnated with conductive particles.

During assembly of connector 10, first portion 815 of biasing element 810 may be engaged with flanged base portion 38, e.g., by forcing the inside diameter of first portion 815 over the angled outside diameter of lip portion 805. Continued rearward movement of biasing element 810 relative to flanged base portion 38 causes detents 835 to engage annular notch portion 800, thereby retaining biasing element 810 to annular post 16, while enabling biasing element 810 to freely rotate with respect to annular post 16.

Figure 9:
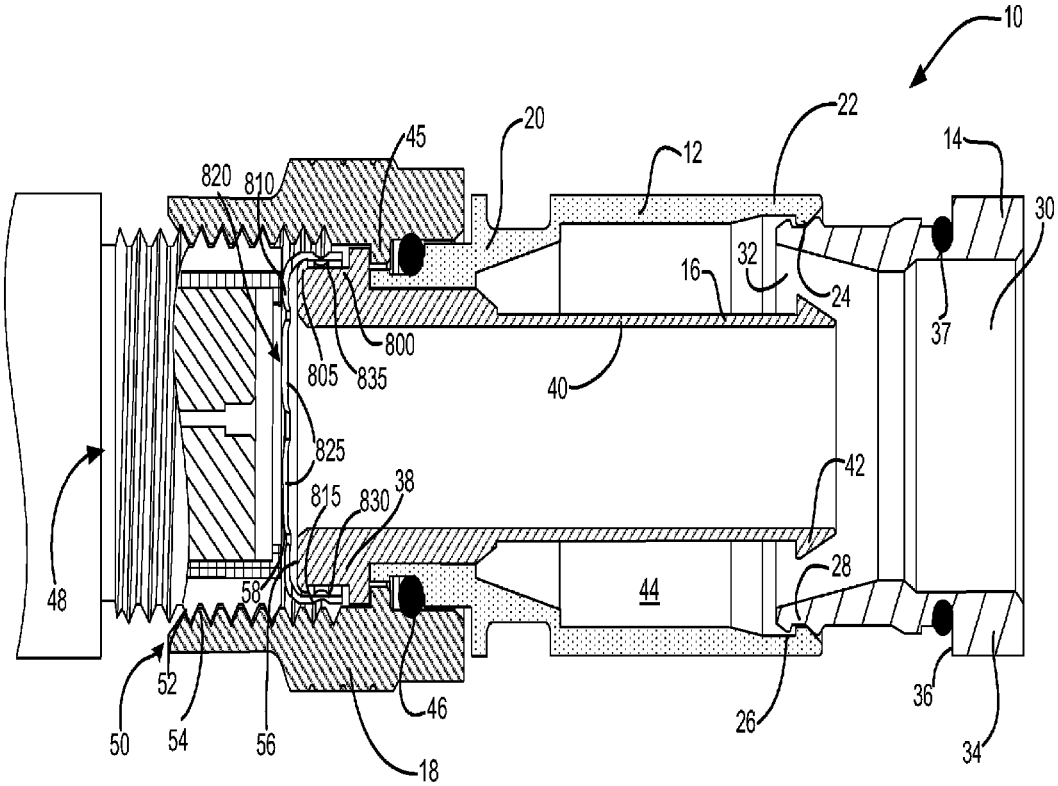
FIG. 9 is a cross-sectional view of the coaxial cable connector of FIG. 8 in a connected configuration.

In an initial, uncompressed state (as shown in FIG. 9), slotted resilient fingers 825 of biasing element 810 may extend a length "z" beyond forward surface 56 of annular post 16. Upon insertion of port connector 48 (e.g., via rotatable threaded engagement between threads 52 and threads 54 as shown in FIG. 9), rearward surface 58 of port connector 48 may come into contact with resilient fingers 825. In a position of initial contact between port connector 48 and biasing element 810 (not shown), rearward surface 58 of port connector 48 may be separated from forward surface 56 of annular post 16 by the distance "z." The conductive nature of biasing element 81 may enable effective transmission of electrical and RF signals from port connector 48 to annular post 16 even when separated by distance z, effectively increasing the reference plane of connector 10. In one implementation, the above-described configuration enables a functional gap or "clearance" of less than or equal to approximately 0.043 inches, for example 0.033 inches, between the reference planes, thereby enabling approximately 360 degrees or more of "back-off" rotation of annular nut 18 relative to port connector 48 while maintaining suitable passage of electrical and/or RF signals.

Continued insertion of port connector 48 into connector 10 may cause compression of resilient fingers 825, thereby providing a load force between flanged base portion 38 and port connector 48 and decreasing the distance between rearward surface 58 of port connector 48 and forward surface 56 of annular post 16. This load force may be transferred to threads 52 and 54, thereby facilitating constant tension between threads 52 and 54 and decreasing the likelihood that port connector 48 will become loosened from connector 10 due to external forces, such as vibrations, heating/cooling, etc.

Upon installation, the annular post 16 may be incorporated into a coaxial cable between the cable foil and the cable braid and may function to carry the RF signals propagated by the coaxial cable. In order to transfer the signals, post 16 makes contact with the reference plane of the mating connector (e.g., port connector 48). By retaining biasing element 810 in notch 800 in annular post 16, biasing element 810 is able to ensure electrical and RF contact at the reference plane of port connector 48. The stepped nature of post 16 enables compression of biasing element 810, while simultaneously supporting direct interfacing between post 16 and port connector 48. Further, compression of biasing element 810 provides equal and opposite biasing forces between the internal threads of nut 18 and the external threads of port connector 48.

Figure 12A:
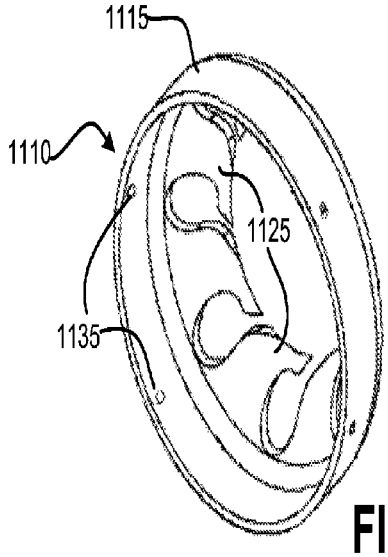
FIG. 12A is an enlarged, isometric view of an exemplary biasing element of FIG. 11.
Figure 11:
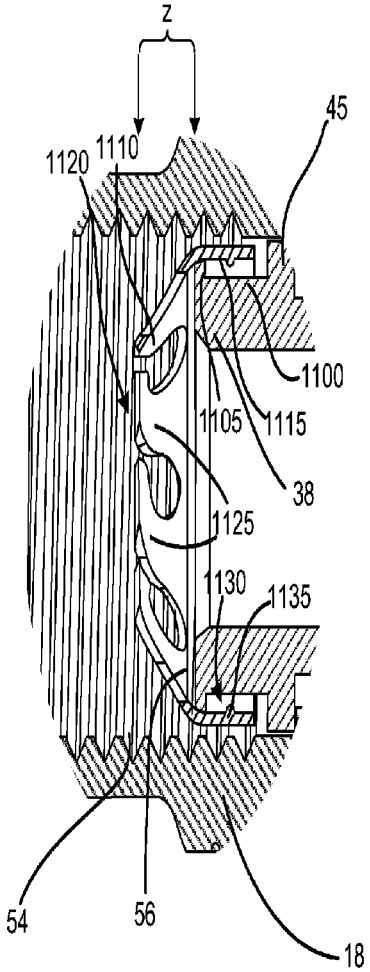
FIG. 11 is a cross-sectional view of another exemplary biasing element.
Figure 12B:
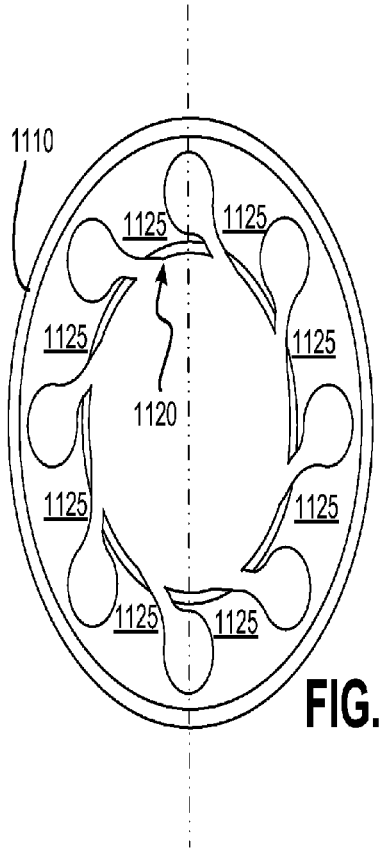
FIG. 12B is an enlarged axial view of the biasing element of FIG. 12A taken along line A of FIG. 8.

Referring now to FIGS. 11, 12A, and 12B, an alternative implementation of a forward portion of connector 10 is shown. As illustrated in FIG. 11, flanged base portion 38 may include annular notch portion 1100 and an outwardly extending lip portion 1105, with annular notch portion 1100 having a smaller outside diameter than lip portion 1105 as described above in FIGS. 8 and 9. Annular notch portion 1100 may be configured to retain a biasing element 1110. In one implementation, the outside diameter of a forward surface of lip portion 1105 may be beveled, chamfered, or otherwise angled, such that a forwardmost portion of lip portion 1105 has a smaller inside diameter than a readwardmost portion of lip portion 1105. For example, forwardmost portion of lip portion 1105 may include an outside 25° radius curve, although any suitable degrees of curvature may be used. Such a configuration may enable efficient assembly of a biasing element 1110 with annular post 16, as described in additional detail below. In addition, in some implementations, biasing element 1110 may include an inside 25° radius curve to match the outside curve on lip portion 1105.

As illustrated in FIGS. 11, 12A, and 12B, biasing element 1110 may include a conductive, resilient element configured to provide a suitable biasing force between annular post 16 and rearward surface (e.g., rearward surface 58 of FIG. 9) of a port connector (e.g., port connector 48 of FIG. 9). The conductive nature of biasing element 1110 may facilitate passage of electrical and RF signals from annular post 16 to port connector 48 at varying degrees of insertion relative to port connector 48 and connector 10.

In one implementation, biasing element 1110 may include a conical spring having a substantially cylindrical first portion 1115 configured to engagingly surround at least a portion of flanged base portion 38, and a second portion 1120 having a number of slotted resilient fingers 1125 configured in a curved, substantially conical manner with respect to first portion 1115. As illustrated in FIGS. 12A and 12B, a forward end of second portion 1120 may have a smaller diameter than the diameter of rearward end of second portion 1120 and first portion 1115.

In one exemplary embodiment, resilient fingers 1125 may be formed in a radially curving manner, such that each finger 1125 extends radially along its length. Resilient fingers 1125 may be equally spaced around the circumference of biasing element 1110, such that biasing element 1110 includes eight, equally spaced, resilient fingers. The number of resilient fingers 1125 disclosed in FIGS. 12A and 12B is exemplary and any suitable number of resilient fingers 1125 may be used in a manner consistent with implementations described herein.

First portion 1115 of biasing element 1110 may be configured to have an inside diameter substantially equal to the outside diameter of lip portion 1105. First portion 1115 may be further configured to include a number of attachment elements 1130 designed to engage notch portion 1110 of flanged base portion 38. As illustrated in FIGS. 11, 12A and 12B, in one exemplary implementation, attachment elements 1130 may include a number of dimples or detents 1135 formed in first portion 1115, such that an interior of each detent 1135 projects within the interior diameter of first portion 1115. Detent 1135 may be formed by forcefully applying a suitably shaped tool, such as an awl or the like, to the outside diameter of first portion 1115. In one exemplary implementation, first portion 1115 may include four detents 1135 formed around a periphery thereof.

In one embodiment, biasing element 1110 may be formed of a metallic material, such as spring steel, having a thickness of approximately 0.008 inches. In other implementations, biasing element 1110 may be formed of a resilient, elastomeric, rubber, or plastic material, impregnated with conductive particles. Furthermore, in an exemplary implementation, biasing element 1110 may have an inside diameter of approximately 0.314 inches, with first portion 1115 having a length of approximately 0.080 inches and second portion 1120 having an axial length of approximately 0.059 inches. Each of radially curved fingers 1125 may have an angle of approximately 45° relative to an axial direction of biasing element 1110. The forward end of second portion 1120 may have a diameter of approximately 0.196 inches and the rearward end of second portion 1120 may have a diameter of approximately 0.330 inches. Each dimple or detent 1135 may have a radius of approximately 0.020 inches.

During assembly of connector 10, first portion 1115 of biasing element 1110 may be engaged with flanged base portion 38, e.g., by forcing the inside diameter of first portion 1115 over the angled outside diameter of lip portion 1105. Continued rearward movement of biasing element 1110 relative to flanged base portion 38 causes detents 1135 to engage annular notch portion 1100, thereby retaining biasing element 1110 to annular post 16, while enabling biasing element 1110 to freely rotate with respect to annular post 16.

In an initial, uncompressed state (as shown in FIG. 11), slotted resilient fingers 1125 of biasing element 1110 may extend a length "z" beyond forward surface 56 of annular post 16. Upon insertion of port connector 48 (e.g., via rotatable threaded engagement between threads 52 and threads 54), rearward surface 58 of port connector 48 may come into contact with resilient fingers 1125. In a position of initial contact between port connector 48 and biasing element 1110 (not shown), rearward surface 58 of port connector 48 may be separated from forward surface 56 of annular post 16 by the distance "z." The conductive nature of biasing element 1110 may enable effective transmission of electrical and RF signals from port connector 48 to annular post 16 even when separated by distance z, effectively increasing the reference plane of connector 10.

Continued insertion of port connector 48 into connector 10 may cause compression of resilient fingers 1125, thereby providing a load force between flanged base portion 38 and port connector 48 and decreasing the distance between rearward surface 58 of port connector 48 and forward surface 56 of annular post 16. This load force may be transferred to threads 52 and 54, thereby facilitating constant tension between threads 52 and 54 and decreasing the likelihood that port connector 48 will become loosened from connector 10 due to external forces, such as vibrations, heating/cooling, etc.

Figure 13:
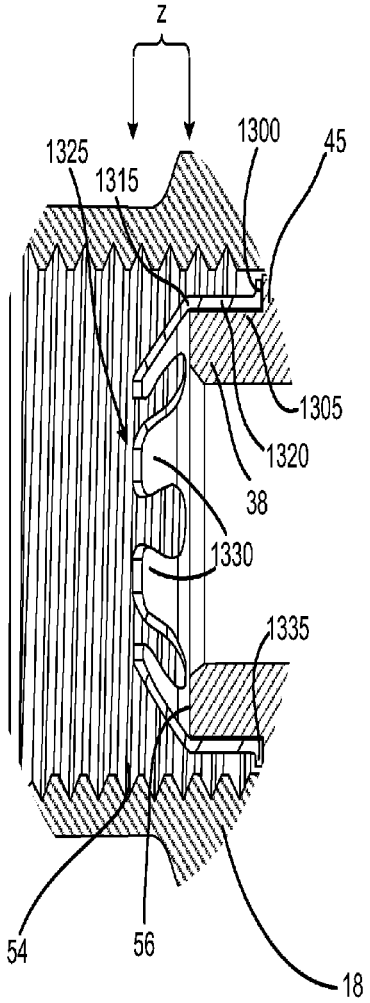
FIG. 13 is a cross-sectional view of yet another exemplary biasing element of the coaxial cable connector of FIG. 1.
Figure 14A:
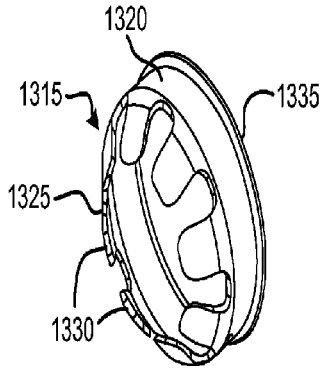
FIG. 14A is an enlarged, isometric view of the biasing element of FIG. 13.
Figure 14B:
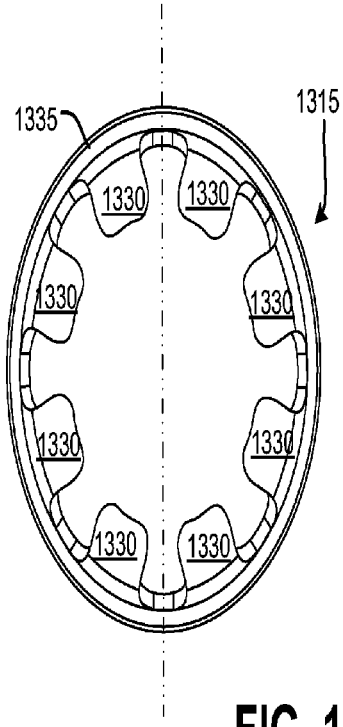
FIG. 14B is an enlarged axial view of the biasing element of FIG. 14A taken along line A of FIG. 13.

Referring now to FIGS. 13, 14A, and 14B, another alternative implementation of a forward portion of connector 10 is illustrated. As illustrated in FIG. 13, unlike in the embodiments of FIGS. 8-12B, flanged base portion 38 may be substantially cylindrical and may not include an annular notch portion. Flanged base portion 38 may include annular flange 45 having a forward surface 1300 and a body portion 1305 having forward surface 56. In one implementation, the outside diameter of forward surface 56 of body portion 1305 may be beveled, chamfered, or otherwise angled, such that a forwardmost portion of body portion 1305 has a smaller inside diameter than a readwardmost portion of body portion 1305. For example, forwardmost portion of body portion 1305 may include an outside 25° radius curve, although any other degrees of curvature may be used. Such a configuration may enable efficient assembly of a biasing element 1315 with annular post 16, as described in additional detail below. In addition, in some implementations, biasing element 1315 may include an inside 25° radius curve to match the outside curve on body portion 1305.

As illustrated in FIGS. 13, 14A, and 14B, biasing element 1315 may include a conductive, resilient element configured to provide a suitable biasing force between annular post 16 and rearward surface (e.g., rearward surface 58 of FIG. 9) of a port connector (e.g., port connector 48 of FIG. 9). The conductive nature of biasing element 1315 may facilitate passage of electrical and RF signals from annular post 16 to port connector 48 at varying degrees of insertion relative to port connector 48 and connector 10.

In one implementation, biasing element 1315 may include a conical spring having a first, substantially cylindrical attachment portion 1320 configured to engagingly surround at least a portion of body portion 1305 of flanged base portion 38, and a second portion 1325 having a number of slotted resilient fingers 1330 configured in a substantially conical manner with respect to first portion 1320. As illustrated in FIGS. 14A and 14B, a forward end of second portion 1325 may have a smaller diameter than the diameter of rearward end of second portion 1325 and first portion 1320.

First portion 1320 of biasing element 1315 may be configured to have an inside diameter substantially equal to the outside diameter of body portion 1305. In addition, first portion 1320 of biasing element 1315 may include a flange 1335 extending annularly from its rearward end. Flange 1335 may be configured to enable biasing element 1315 to be press-fit by an appropriate tool or device about body portion 1305, such that biasing element 1315 is frictionally retained against body portion 1305.

In one exemplary embodiment, resilient fingers 1330 may be equally spaced around a circumference of biasing element 1315, such that biasing element 1315 includes eight resilient fingers 1330, with a centerline of each finger 1330 being positioned approximately 45° from its adjacent fingers 1330. The number of resilient fingers 1330 illustrated in FIGS. 14A and 14B (e.g., eight fingers 1330) is exemplary and any suitable number of resilient fingers 1330 may be used in a manner consistent with implementations described herein.

In one embodiment, biasing element 1315 may be formed of a metallic material, such as spring steel, having a thickness of approximately 0.008 inches. In other implementations, biasing element 1315 may be formed of a resilient, elastomeric, rubber, or plastic material, impregnated with conductive particles. Furthermore, in an exemplary implementation, biasing element 1315 may have an inside diameter of approximately 0.285 inches, with first portion 1320 having a length of approximately 0.080 inches and second portion 1325 having an axial length of approximately 0.059 inches. Each of resilient fingers 1330 may have an angle of approximately 45° relative to an axial direction of biasing element 1315. The forward end of second portion 1325 may have a diameter of approximately 0.196 inches and the rearward end of second portion 1325 may have a diameter of approximately 0.301 inches.

During assembly of connector 10, first portion 1320 of biasing element 1315 may be engaged with flanged base portion 38, e.g., by forcing the inside diameter of first portion 1320 over the angled outside diameter of body portion 1305. Continued rearward movement of biasing element 1315 relative to body portion 1305, e.g., via force exerted on flange 1335, may cause biasing element 1315 to engage body portion 1305, thereby retaining biasing element 1315 to annular post 16.

In an initial, uncompressed state (as shown in FIG. 13), slotted resilient fingers 1330 of biasing element 1315 may extend a length "z" beyond forward surface 56 of annular post 16. Upon insertion of port connector 48 (e.g., via rotatable threaded engagement between threads 52 and threads 54 as shown in FIG. 9), rearward surface 58 of port connector 48 may come into contact with resilient fingers 1330. In a position of initial contact between port connector 48 and biasing element 1315 (not shown), rearward surface 58 of port connector 48 may be separated from forward surface 56 of annular post 16 by the distance "z."

The conductive nature of biasing element 1315 may enable effective transmission of electrical and RF signals from port connector 48 to annular post 16 even when separated by distance z, effectively increasing the reference plane of connector 10. Continued insertion of port connector 48 into connector 10 may cause compression of resilient fingers 1330, thereby providing a load force between flanged base portion 38 and port connector 48 and decreasing the distance between rearward surface 58 of port connector 48 and forward surface 56 of annular post 16. This load force may be transferred to threads 52 and 54, thereby facilitating constant tension between threads 52 and 54 and decreasing the likelihood that port connector 48 will become loosened from connector 10 due to external forces, such as vibrations, heating/cooling, etc.

Figure 15A:
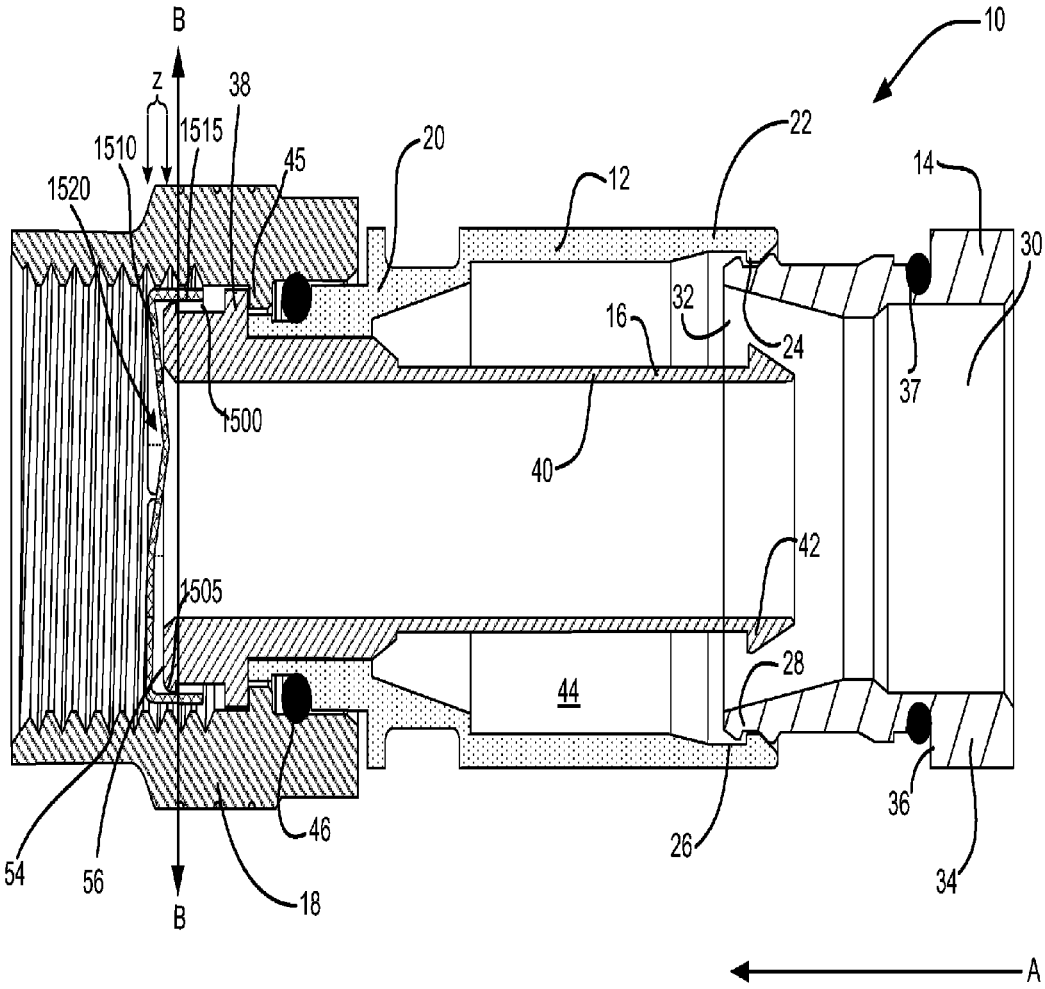
FIG. 15A is a cross-sectional view of another exemplary embodiment of the coaxial cable connector of FIG. 1 in an unconnected configuration.
Figure 15B:
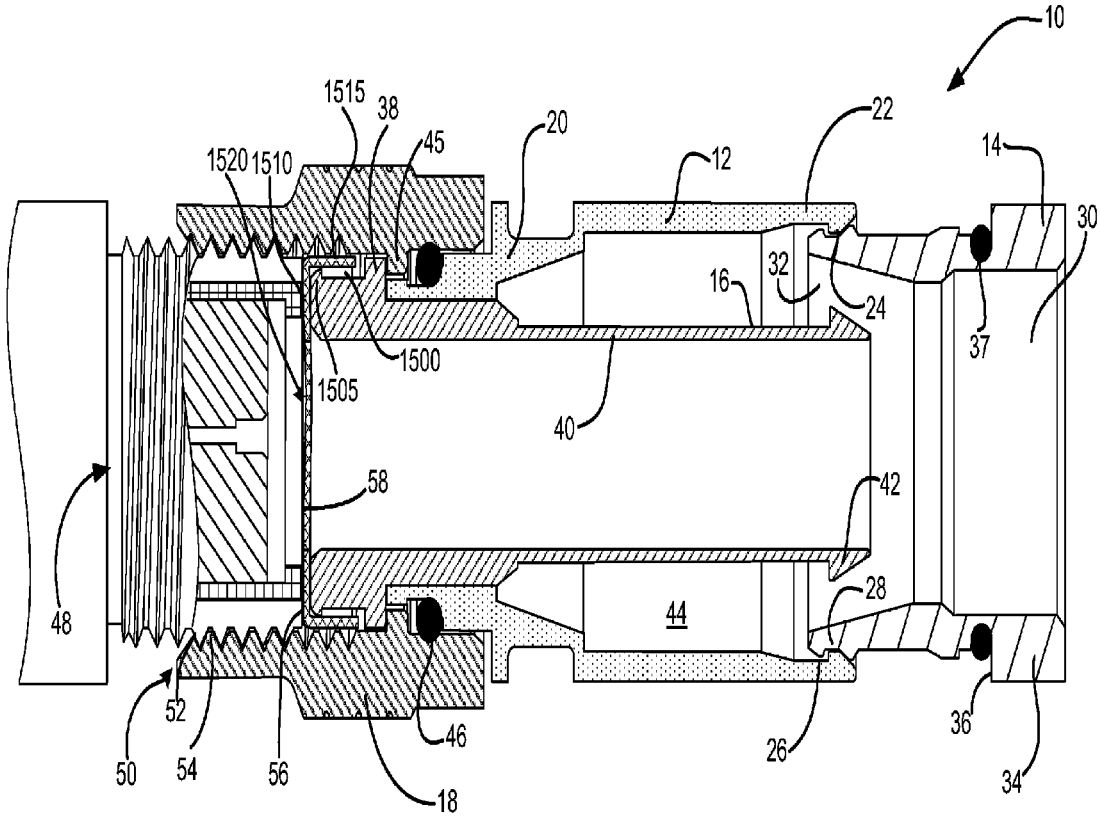
FIG. 15B is a cross-sectional view of the coaxial cable connector of FIG. 15A in a connected configuration.
Figure 16:
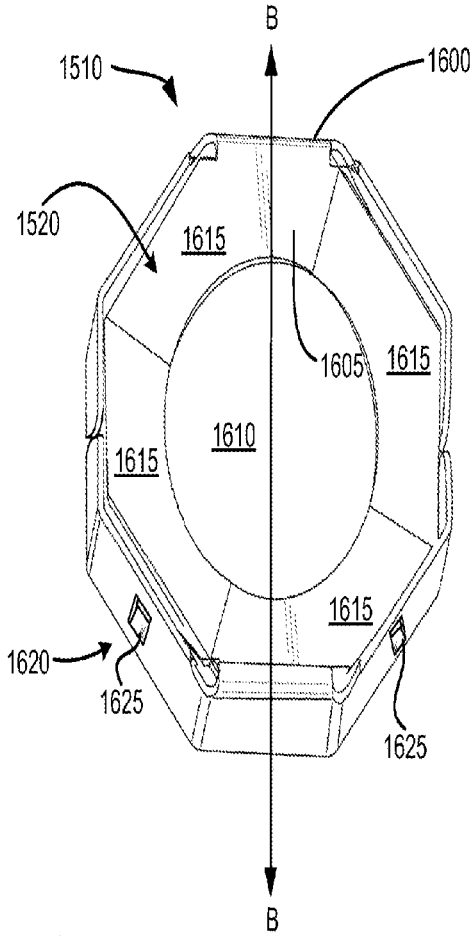
FIG. 16 is an enlarged, isometric view of the biasing element of FIGS. 15A-15B.

Referring now to FIGS. 15A-16, an alternative implementation of a forward portion of connector 10 is shown. As illustrated in FIG. 15A, flanged base portion 38 may be configured to include a notched configuration that includes an annular notch portion 1500 and an outwardly extending lip portion 1505, with annular notch portion 1500 having a smaller outside diameter than lip portion 1505. Annular notch portion 1500 may be configured to retain a biasing element 1510 therein. In one implementation, the outside diameter of a forward surface of lip portion 1505 may beveled, chamfered, or otherwise angled, such that a forwardmost portion of lip portion 1505 has a smaller inside diameter than a readwardmost portion of lip portion 1505. For example, forwardmost portion of lip portion 1505 may include an outside 25° radius curve, although other degrees of curvature may be used in other implementations. Such a configuration may enable efficient assembly of biasing element 1510 with annular post 16, as described in additional detail below. In addition, in some implementations, biasing element 1510 may include an inside 25° radius curve to match the outside curve on lip portion 1505.

Consistent with implementations described herein, biasing element 1510 may include a conductive, resilient element configured to provide a suitable biasing force between annular post 16 and rearward surface 58 of port connector 48 (as shown in FIG. 15B). The conductive nature of biasing element 1510 may facilitate passage of electrical and radio frequency (RF) signals from annular post 16 to port connector 48 at varying degrees of insertion relative to port connector 48 and connector 10.

In one implementation, biasing element 1510 may include a stamped, multifaceted spring having a first, substantially octagonal attachment portion 1515 configured to engagingly surround at least a portion of flanged base portion 38, and a second, resilient portion 1520 having a number angled or beveled spring surfaces extending in a resilient relationship from attachment portion 1515. Second, resilient portion 1520 may include an opening therethrough corresponding to tubular extension 40 in annular post 16.

For example, as will be described in additional detail below with respect to FIG. 16, biasing element 1510 may be formed of spring steel or stainless steel, with second portion 1520 being formed integrally with first portion 1515 and bent more than 90° relative to first portion 1515. FIG. 16 illustrates an exemplary biasing element 1510 taken along the line B-B in FIG. 15A. As illustrated in FIG. 16, biasing element 1510 may include an octagonal outer ring 1600 integrally formed with a resilient portion 1605 having an opening 1610 extending therethrough.

For example, biasing element 1510 may be initially cut (e.g., die cut) from a sheet of conductive material, such as steel, spring steel, or stainless steel having a thickness of approximately 0.008 inches. Octagonal outer ring 1600 may be bent downward from resilient portion 1605 until outer ring 1600 is substantially perpendicular to a plane extending across an upper surface of resilient portion 1605. Angled or beveled surfaces 1615 may be formed in resilient portion 1605, such that differences in an uncompressed thickness of resilient portion 1605 are formed. For example, resilient portion 1605 may be stamped or otherwise mechanically deformed to form a number of angled surfaces, where a lowest point in at least two of the angled surfaces are spaced a predetermined distance in a vertical (or axial) direction (e.g., 0.04 inches) from the upper edge of octagonal outer ring 1600. In essence, the formation of angled or curved surfaces in resilient portion 1605 creates a spring relative to octagonal outer ring 1600.

As shown in FIG. 15A, at least a portion of second portion 1520 extends in an angled manner from a forward edge of attachment portion 1515. Accordingly, in a first position (in which port connector 48 is not attached to connector 10), the angled nature of second portion 1520 causes second portion 1520 to abut a forward edge 56 of annular post 16, while the forward edge of attachment portion 1515 is separated from forward edge 56 of annular post 16, as depicted by the length "z" in FIG. 15A.

In a second position, as shown in FIG. 15B (in which port connector 48 is compressingly attached to connector 10), compressive forces imparted by port connector 48 may cause the angled surfaces on second portion 1520 to flatten out, thereby reducing the separation between the forward edge of attachment portion 1515 and forward edge 56 of annular post 16. Consequently, in this position, rearward edge 58 of port connector 48 is also brought closer to forward edge 56 of annular post 16.

First portion 1515 of biasing element 1510 may be configured to have a minimum inside width (e.g., between opposing octagonal sections) substantially equal to the outside diameter of lip portion 1505. First portion 1515 may be further configured to include a number of attachment elements 1620 designed to engage notch portion 1500 of flanged base portion 38. As illustrated in FIG. 16, in one exemplary implementation, attachment elements 1620 may include a number of detents or tabs 1625 formed in first portion 1515, such that an interior of each tab 1625 projects within the interior width of first portion 1515. These detents or tabs may be referred to as "lantzes" and may be formed by forcefully applying a suitably shaped tool, such as an awl, hammer, etc., to the outside surfaces of first portion 1515. In one exemplary implementation, first portion 1515 may include four tabs 1625 (two of which are shown in FIG. 16) formed around a periphery of first portion 1515. In another exemplary implementation (not shown), more or fewer tabs 1625 may be formed around the periphery of first portion 1515 to engage notch portion 1500.

During assembly of connector 10, first portion 1515 of biasing element 1510 may be engaged with flanged base portion 38, e.g., by forcing first portion 1515 over the angled outside diameter of lip portion 1505. Continued rearward movement of biasing element 1510 relative to flanged base portion 38 causes detents 1625 to engage annular notch portion 1500, thereby retaining biasing element 1510 to annular post 16, while enabling biasing element 1510 to freely rotate with respect to annular post 16.

In an initial, uncompressed state (as shown in FIG. 15A), abutment of second portion 1520 of biasing element 1510 may cause the forward edge of attachment portion 1515 to extend length "z" beyond forward surface 56 of annular post 16. Upon insertion of port connector 48 (e.g., via rotatable threaded engagement between threads 52 and threads 54 as shown in FIG. 15B), rearward surface 58 of port connector 48 may come into contact with the forward edge of attachment portion 1515. In a position of initial contact between port connector 48 and biasing element 1510 (not shown), rearward surface 58 of port connector 48 may be separated from forward surface 56 of annular post 16 by the distance "z." The conductive nature of biasing element 1510 may enable effective transmission of electrical and RF signals from port connector 48 to annular post 16 even when separated by distance z, effectively increasing the reference plane of connector 10. In one implementation, the above-described configuration enables a functional gap or "clearance" of less than or equal to approximately 0.040 inches, for example 0.033 inches, between the reference planes, thereby enabling approximately 360 degrees or more of "back-off" rotation of annular nut 18 relative to port connector 48 while maintaining suitable passage of electrical and/or RF signals.

Continued insertion of port connector 48 into connector 10 may cause compression of second, angled portion 1520, thereby providing a load force between flanged base portion 38 and port connector 48 and decreasing the distance between rearward surface 58 of port connector 48 and forward surface 56 of annular post 16. This load force may be transferred to threads 52 and 54, thereby facilitating constant tension between threads 52 and 54 and decreasing the likelihood that port connector 48 will become loosened from connector 10 due to external forces, such as vibrations, heating/cooling, etc.

Upon installation, the annular post 16 may be incorporated into a coaxial cable between the cable foil and the cable braid and may function to carry the RF signals propagated by the coaxial cable. In order to transfer the signals, post 16 makes contact with the reference plane of the mating connector (e.g., port connector 48). By retaining biasing element 1510 in notch 1500 in annular post 16, biasing element 1510 is able to ensure electrical and RF contact at the reference plane of port connector 48. The stepped nature of post 16 enables compression of biasing element 1510, while simultaneously supporting direct interfacing between post 16 and port connector 48. Further, compression of biasing element 1510 provides equal and opposite biasing forces between the internal threads of nut 18 and the external threads of port connector 48.

Referring now to FIGS. 17-22, alternative implementations of biasing elements are shown. Each of the embodiments illustrated in FIGS. 17-22 are configured for attachment to notched portion 1500 in annular post 16 in a manner similar to that described above in relation to FIGS. 15A-16.

Figure 17:
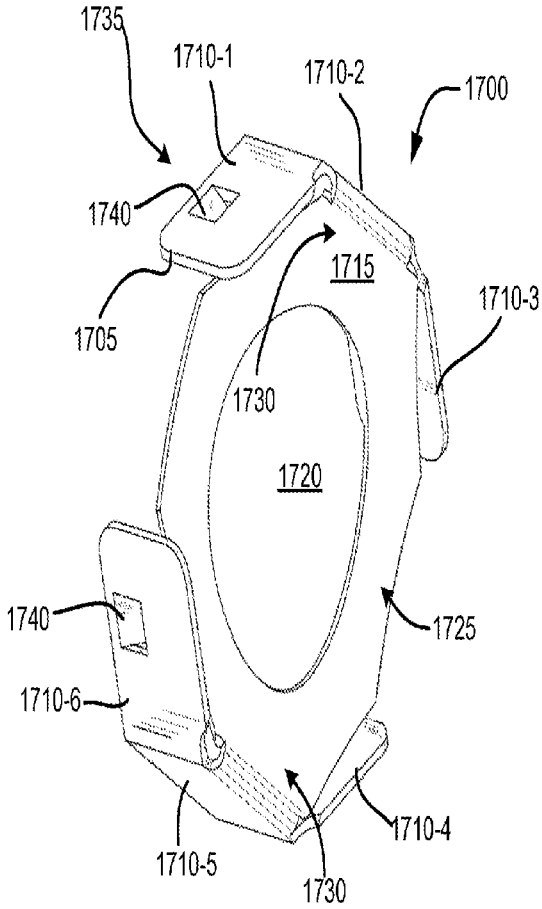

FIG. 17 illustrates an exemplary biasing element 1700 consistent with embodiments described herein. As shown in FIG. 17, biasing element 1700, similar to biasing element 1510 described above in relation to FIGS. 15A-16, includes a substantially octagonal attachment portion 1705 having six angled sides 1710-1 to 1710-6 and a resilient center portion 1715 having a central opening 1720 provided therein. Unlike octagonal ring 1600 of FIG. 16, attachment portion 1705 of FIG. 17 does not extend substantially throughout each of the eight possible sides in its octagonal perimeter. Instead, as illustrated in FIG. 17, attachment portion 1705 may include six of the octagonal perimeters sides 1710-1 to 1710-6, with opposing seventh and eighth sides not including corresponding attachment portion sides. Reducing the number of sides provided may decrease expense without detrimentally affecting performance.

In one implementation, attachment portion 1705 and center portion 1715 may be integrally formed from a sheet of resilient material, such as spring or stainless steel. As illustrated in FIG. 17, attachment portion 1705 may be formed by bending sides 1710-1 to 1710-6 substantially perpendicular relative to center portion 1715. In one embodiment, attachment portion 1705 may be connected to center portion 1715 via bends in sides 1710-2 and 1710-5.

Resilient center portion 1715 may include a curved or U-shaped configuration, configured to provide center portion 1715 with a low portion 1725 disposed between sides 1710-2 and 1710-4 and high portions 1730 adjacent sides 1710-4 and 1710-6. That is, resilient center portion 1715 is formed to create a trough between opposing portions of attachment portion 1705.

When the connector is in a first position (in which port connector 48 is not attached to connector 10), the relationship between low portion 1725 and high portions 1730 causes low portion 1725 of biasing element 1700 to abut a forward edge of annular post 16, while high portions 1730 of biasing element 1700 are separated from the forward edge of annular post 16 by a distance equivalent to the depth of the trough formed between low portion 1725 and high portions 1730.

Figure 5B:
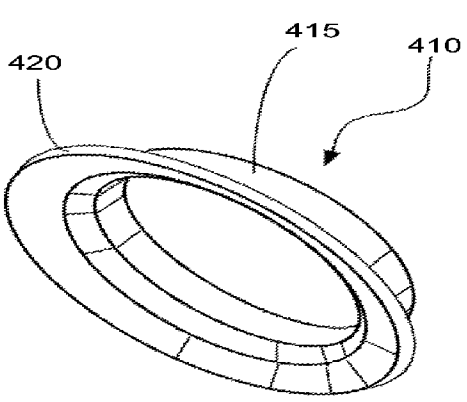
FIGS. 5A and 5B are perspective views of the biasing element of the connector shown in FIG. 4.
Figure 5A:
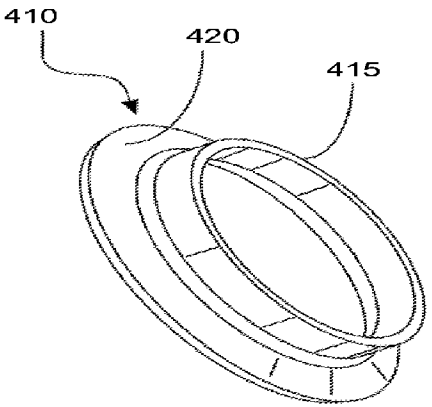

In a second position, similar to that shown in FIG. 5B (in which port connector 48 is compressingly attached to connector 10), compressive forces imparted by port connector 48 may cause resilient center portion 1715 to flatten out, thereby reducing the separation between low portion 1725 and high portions 1730. Consequently, in this position, rearward edge 58 of port connector 48 is also brought closer to forward edge 56 of annular post 16.

Attachment portion 1705 of biasing element 1700 may be configured to have a minimum inside width (e.g., between opposing octagonal sections) substantially equal to the outside diameter of lip portion 1505. Attachment portion 1705 may be further configured to include a number of attachment elements 1735 designed to engage notch portion 1500 of flanged base portion 38. As illustrated in FIG. 17, in one exemplary implementation, attachment elements 1735 may include a number of detents or tabs 1740 formed in attachment portion 1705, such that an interior of each tab 1740 projects within the interior width of attachment portion 1705. In one exemplary implementation, attachment portion 1705 may include four tabs 1740 (two of which are shown in FIG. 17) formed around a periphery of attachment portion 1705. In another exemplary implementation (not shown), more or fewer tabs 1740 may be formed around the periphery of attachment portion 1705 to engage notch portion 56 in annular post 16.

During assembly of connector 10, attachment portion 1705 of biasing element 1700 may be engaged within flanged base portion 38, e.g., by forcing attachment portion 1705 over the angled outside diameter of lip portion 1505. Continued rearward movement of biasing element 1700 relative to flanged base portion 38 causes tabs 1740 to engage annular notch portion 1500, thereby retaining biasing element 1700 to annular post 16, while enabling biasing element 1700 to freely rotate with respect to annular post 16.

FIG. 18 illustrates an exemplary biasing element 1800 consistent with embodiments described herein. As shown in FIG. 18, biasing element 1800, similar to biasing element 60 in FIGS. 15A-16, may include a substantially octagonal attachment portion 1805 having angled sides 1810-1 to 1810-8 and a resilient center portion 1815 having a central opening 1820 provided therein. Resilient center portion 1815 may be formed substantially perpendicularly with attachment portion 1805.

As illustrated in FIG. 18, attachment portion 1805 may include a number of tabbed portions 1825-1 to 1825-4 integrally formed with at least some of angled sides 1810-1 to 1810-8. For example, tabbed portion 1825-1 may be integrally formed with angled side 1810-3, tabbed portion 1825-2 may be integrally formed with angled side 1810-5, tabbed portion 1825-3 may be integrally formed with angled side 1810-7, and tabbed portion 1825-4 may be integrally formed with angled side 1810-1.

Tabbed portions 1825-1 to 1825-4 may include resilient tabs 1830-1 to 1830-4, respectively, having an angled surface and configured to resiliently project from a first end 1835 adjacent to the top of angled sides 1810 to a second end 1840 distal from, and lower than, first end 1835. In one exemplary embodiment, second distal end 1840 is approximately 0.04" lower (e.g., in a vertical or axial direction) than first end 1835 of resilient tabs 1830-1 to 1830-4.

In one implementation, the angled surfaces of resilient tabs 1830-1 to 1830-4 may be configured to provide the biasing force between annular post 16 and port connector 48. As shown in FIG. 18, the angled surfaces of resilient tabs 1830-1 to 1830-4 may be configured in such a manner as to render central opening 1820 substantially rectangular in shape.

For example, resilient tabs 1830-1 to 1830-4 may project from respective angled sides 1810-3, 1810-5, 1810-7, and 1810-1 in a parallel relationship to an adjacent angled side (e.g., side 1810-2, 1810-4, 1810-6, or 1810-8). For example, tabbed portion 1825-2 may project from angled side 1810-5 with resilient tab 1830-2 projecting from tabbed portion 1825-2 parallel to angled side 1810-4. In one implementation, attachment portion 1805 and central portion 1815 may be stamped from a sheet of resilient material, such as spring or stainless steel.

When the connector is in a first position (in which port connector 48 is not attached to connector 10), the relationship between second ends 1840 of resilient tabs 1830-1 to 1830-4 and first ends 1835 of resilient tabs 1830-1 to 1830-4 may cause second ends 1840 of resilient tabs 1830-1 to 1830-4 to abut a forward edge of annular post 16, while first ends 1835 of resilient tabs 1830-1 to 1830-4 are separated from the forward edge of annular post 16.

In a second position, similar to that shown in FIG. 15B (in which port connector 48 is compressingly attached to connector 10), compressive forces imparted by port connector 48 may cause resilient tabs 1830-1 to 1830-4 to flatten out, thereby reducing the separation between first portions 1835 and second portions 1840. Consequently, in this position, rearward edge 74 of port connector 48 is also brought closer to the forward edge of annular post 16.

Attachment portion 1805 of biasing element 1800 may be configured to have a minimum inside width (e.g., between opposing octagonal sections) substantially equal to the outside diameter of lip portion 1505. Attachment portion 505 may be further configured to include a number of attachment elements designed to engage notch portion 1500 of flanged base portion 38 (not shown in FIG. 18). Similar to the attachment elements disclosed above in relation to FIG. 17, the attachment elements of the current embodiment may also include a number of tabs, detents, or lantzes for engaging notch portion 1500 in annular post 16 and retaining biasing element 1800 to annular post 16.

During assembly of connector 10, attachment portion 1805 of biasing element 1800 may be engaged within flanged base portion 38, e.g., by forcing attachment portion 505 over the angled outside diameter of lip portion 1505. Continued rearward movement of biasing element 1800 relative to flanged base portion 38 causes the attachment elements to engage annular notch portion 1500, thereby retaining biasing element 1800 to annular post 16, while enabling biasing element 1800 to freely rotate with respect to annular post 16.

FIG. 19 illustrates an exemplary biasing element 1900 consistent with embodiments described herein. As shown in FIG. 19, biasing element 1900, similar to biasing element 1510 in FIGS. 15A-16, may include a first, substantially cylindrical attachment portion 1905 and a resilient center portion 1910 having a central opening 1913 provided therein. Resilient center portion 1910 may be formed substantially perpendicularly to cylindrical attachment portion 1905.

As illustrated in FIG. 19, resilient center portion 1910 may be integrally formed with substantially cylindrical attachment portion 1905 and may include a number of arcuate tabbed portions 1915-1 to 1915-3 connected to attachment portion 1905 by spoke portions 1920-1 to 1920-3. Attachment portion 1905 may also include a center support ring 1925 attached to an inside edge of spoke portions 1920-1 to 1920-3. Central support ring 1925 may be positioned in a plane substantially level (e.g., in an axial direction) with spoke portions 1920 and an upper edge of attachment portion 1905.

Arcuate tabbed portions 1915-1 to 1915-3 may include resilient tabs 1930-1 to 1930-3, respectively, having an angled surface and configured to resiliently project from spoke portions 1920-1 to 1920-3, respectively. For each tab 1930-1 to 1930-3, a first end 1935 is radially connected to spoke portion 1920-1 to 1920-3, respectively. Each tab 1930-1 to 1930-3 extends from first end 1935 to a second end 1940 distal from, and lower than, first end 1935. In one exemplary embodiment, second distal end 1940 is approximately 0.04" lower than a respective spoke portion 1920 (e.g., in a vertical or axial direction).

In one implementation, the angled surfaces of resilient tabs 1930-1 to 1930-3 may be configured to provide the biasing force between annular post 16 and port connector 48. In one implementation, attachment portion 1905 and central portion 1915 may be stamped from a sheet of resilient material, such as spring or stainless steel.

When the connector is in a first position (in which port connector 48 is not attached to connector 10), the relationship between second ends 1940 of resilient tabs 1930-1 to 1930-3 and spoke portions 1920/central support ring 1925 of resilient tabs 1930-1 to 1930-3 may cause second ends 1940 of resilient tabs 1930-1 to 1930-3 to abut a forward edge of annular post 16, while spoke portions 1920/central support ring 1925 are separated from the forward edge of annular post 16.

In a second position, similar to that shown in FIG. 15B (in which port connector 48 is compressingly attached to connector 10), compressive forces imparted by port connector 48 may cause resilient tabs 1930-1 to 1930-3 to flatten out, thereby reducing the separation between spoke portions 1920 and second ends 1940. Consequently, in this position, rearward edge 74 of port connector 48 is also brought closer to the forward edge of annular post 16.

Attachment portion 1905 of biasing element 1900 may be configured to have a minimum inside diameter substantially equal to the outside diameter of lip portion 1505. Attachment portion 1905 may be further configured to include a number of attachment elements designed to engage notch portion 1500 of flanged base portion 38 (not shown in FIG. 19). Similar to the attachment elements disclosed above in relation to FIG. 16, the attachment elements of the embodiment illustrated in FIG. 19 may also include a number of tabs, detents, or lantzes for engaging notch portion 1500 in annular post 16 and retaining biasing element 1900 to annular post 16.

During assembly of connector 10, attachment portion 1905 of biasing element 1900 may be engaged within flanged base portion 38, e.g., by forcing attachment portion 1905 over the angled outside diameter of lip portion 1505. Continued rearward movement of biasing element 1900 relative to flanged base portion 38 causes the attachment elements to engage annular notch portion 1500, thereby retaining biasing element 1900 to annular post 16, while enabling biasing element 1900 to freely rotate with respect to annular post 16.

FIG. 20 illustrates an exemplary biasing element 2000 consistent with embodiments described herein. The embodiment of FIG. 20 is similar to the embodiment illustrated in FIG. 19, and similar reference numbers are used where appropriate. However, in distinction to biasing element 1900 of FIG. 19, spoke portions 2000-1 to 2000-3 in FIG. 20 are substantially larger than spoke portions 1920-1 to 1920-3 in FIG. 19. By design, resilient tabs 2005-1 to 2005-3 in FIG. 20 are shorter in length than resilient tabs 1930-1 to 1930-3. Increasing the size of spoke portions 1930 relative to tabs 2005 may provide increased strength in biasing element 2000.

FIG. 21 illustrates an exemplary biasing element 2100 consistent with embodiments described herein. As shown in FIG. 21, biasing element 2100, similar to biasing element 1900 in FIG. 19, may include a first, substantially cylindrical attachment portion 2105 and a resilient center portion 2110 having a central opening 2115 provided therein. Resilient center portion 2110 may be formed substantially perpendicularly to cylindrical attachment portion 2105. As illustrated in FIG. 21, resilient center portion 2110 may be integrally formed with substantially cylindrical attachment portion 2105 and may include a circular hub portion 2120 that includes a number of radially spaced tab openings 2125-1 to 2125-4 formed therein. A number of arcuate, axially projecting tabbed portions 2130-1 to 2130-4 may resiliently depend from circular hub portion 2120 in tab openings 2125-1 to 2125-4, respectively.

Tabbed portions 2130-1 to 2130-4 may include resilient tabs 2135-1 to 2135-4, respectively, having an angled surface and configured to resiliently project within tab openings 2125-1 to 2125-4, respectively. For each tab 2135-1 to 2135-4, a first end 2140 is axially connected to an outside edge of tab openings 2125-1 to 2125-4, respectively. Each tab 2135-1 to 2135-4 extends from first end 2140 to a second end 2145 distal from, and lower than, first end 2140 in an axial direction. In one exemplary embodiment, second distal end 2145 is approximately 0.04" lower than circular hub portion 2120.

In one implementation, the angled surfaces of resilient tabs 2135-1 to 2135-4 may be configured to provide the biasing force between annular post 16 and port connector 48. In one implementation, attachment portion 2105 and central portion 2110 may be stamped from a sheet of resilient material, such as spring or stainless steel.

When the connector is in a first position (in which port connector 48 is not attached to connector 10), the relationship between second ends 2145 of resilient tabs 2135-1 to 2135-4 and circular hub portion 2120 may cause second ends 2145 to abut a forward edge of annular post 16, while circular hub portion 2120 is separated from the forward edge of annular post 16.

In a second position, similar to that shown in FIG. 15B (in which port connector 48 is compressingly attached to connector 10), compressive forces imparted by port connector 48 may cause resilient tabs 2135-1 to 2135-4 to flatten out, thereby reducing the separation between circular hub portion 2120 and second ends 2145. Consequently, in this position, rearward edge 58 of port connector 48 is also brought closer to forward edge 56 of annular post 16.

Attachment portion 2105 of biasing element 2100 may be configured to have a minimum inside diameter substantially equal to the outside diameter of lip portion 1505. Attachment portion 2105 may be further configured to include a number of attachment elements designed to engage notch portion 1500 of flanged base portion 38 (not shown in FIG. 21). Similar to the attachment elements disclosed above in relation to FIG. 16, the attachment elements of the current embodiment may also include a number of tabs, detents, or lantzes for engaging notch portion 1500 in annular post 16 and retaining biasing element 2100 to annular post 16.

During assembly of connector 10, attachment portion 2105 of biasing element 2100 may be engaged within flanged base portion 38, e.g., by forcing attachment portion 2105 over the angled outside diameter of lip portion 1505. Continued rearward movement of biasing element 2100 relative to flanged base portion 38 causes the attachment elements to engage annular notch portion 1500, thereby retaining biasing element 2100 to annular post 16, while enabling biasing element 2100 to freely rotate with respect to annular post 16.

Figure 22:
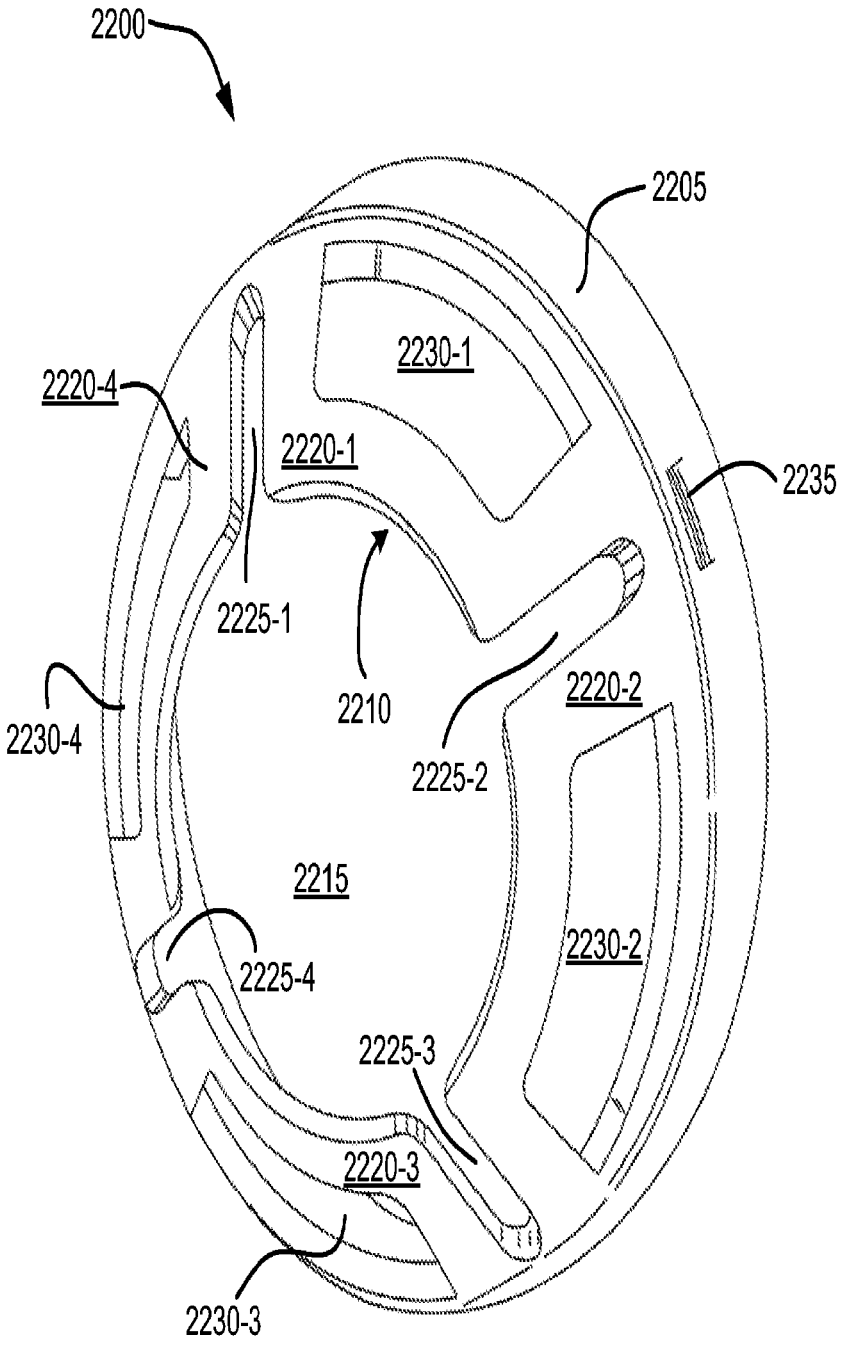

FIG. 22 illustrates an exemplary biasing element 2200 consistent with embodiments described herein. As shown in FIG. 22, biasing element 2200 may include a first, substantially cylindrical attachment portion 2205 and a resilient center portion 2210 having a central opening 2215 provided therein. As illustrated in FIG. 22, resilient center portion 2210 may be integrally formed with substantially cylindrical attachment portion 2205 and may include a number of resilient spring elements 2220-1 to 2220-4 formed therein.

As shown in FIG. 22, resilient spring elements 2220-1 to 2220-4 (collectively, spring elements 2220), may be separated from each other by slots 2225-1 to 2225-4. Further, spring elements 2220 may each include a spring opening 2230 therein (individually, spring openings 2230-1 to 2230-4). Each of spring elements 2220 may be formed in an angled or curved configuration, such that an inside edge of each spring element 2220 (e.g., the edge toward central opening 2215) may be raised relative to an outside edge of each spring element 2220. In one exemplary embodiment, the inside edge of spring elements 2220 may be raised approximately 0.04"-0.05" in an axial direction relative to the outside edge of spring elements 2220.

In one implementation, the angled or curved surfaces of spring elements 2220 may be configured to provide the biasing force between annular post 16 and port connector 48. In one implementation, attachment portion 2205 and resilient portion 2210 may be stamped from a sheet of resilient material, such as spring or stainless steel.

When the connector is in a first position (in which port connector 48 is not attached to connector 10), the relationship between the inside edge of each spring element 2220 to the outside edge of each spring element 2220 may cause the outside edge to abut a forward edge of annular post 16, while the inside edge is separated from the forward edge of annular post 16.

In a second position, similar to that shown in FIG. 15B (in which port connector 48 is compressingly attached to connector 10), compressive forces imparted by port connector 48 may cause resilient spring elements 2220 to flatten out, thereby reducing the separation between the inside edges of spring elements 2220 and the outside edges of spring elements 2220. Consequently, in this position, rearward edge 58 of port connector 48 is also brought closer to forward edge 56 of annular post 16.

Attachment portion 2205 of biasing element 2200 may be configured to have a minimum inside diameter substantially equal to the outside diameter of lip portion 1505. Attachment portion 2205 may be further configured to include a number of attachment elements 2235 designed to engage notch portion 1500 of flanged base portion 38. Similar to the attachment elements disclosed above in relation to FIG. 16, attachment elements 2235 may include a number of tabs, detents, or lantzes for engaging notch portion 1500 in annular post 16 and retaining biasing element 2200 to annular post 16.

During assembly of connector 10, attachment portion 2205 of biasing element 2200 may be engaged within flanged base portion 38, e.g., by forcing attachment portion 2205 over the angled outside diameter of lip portion 1505. Continued rearward movement of biasing element 2200 relative to flanged base portion 38 causes the attachment elements to engage annular notch portion 1500, thereby retaining biasing element 2200 to annular post 16, while enabling biasing element 2200 to freely rotate with respect to annular post 16.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments.

For example, various features have been mainly described above with respect to a coaxial cables and connectors for securing coaxial cables. The above-described connector may pass electrical and radio frequency (RF) signals typically found in CATV, Satellite, closed circuit television (CCTV), voice of Internet protocol (VoIP), data, video, high speed Internet, etc., through the mating ports (about the connector reference planes). Providing a biasing element, as described above, may also provide power bonding grounding (i.e., helps promote a safer bond connection per NEC® Article 250 when the biasing element is under linear compression) and RF shielding (Signal Ingress & Egress).

In other implementations, features described herein may be implemented in relation to other cable or interface technologies. For example, the coaxial cable connector described herein may be used or usable with various types of coaxial cable, such as 50, 75, or 93 ohm coaxial cable, or other characteristic impedance cable designs.

Figure 23:
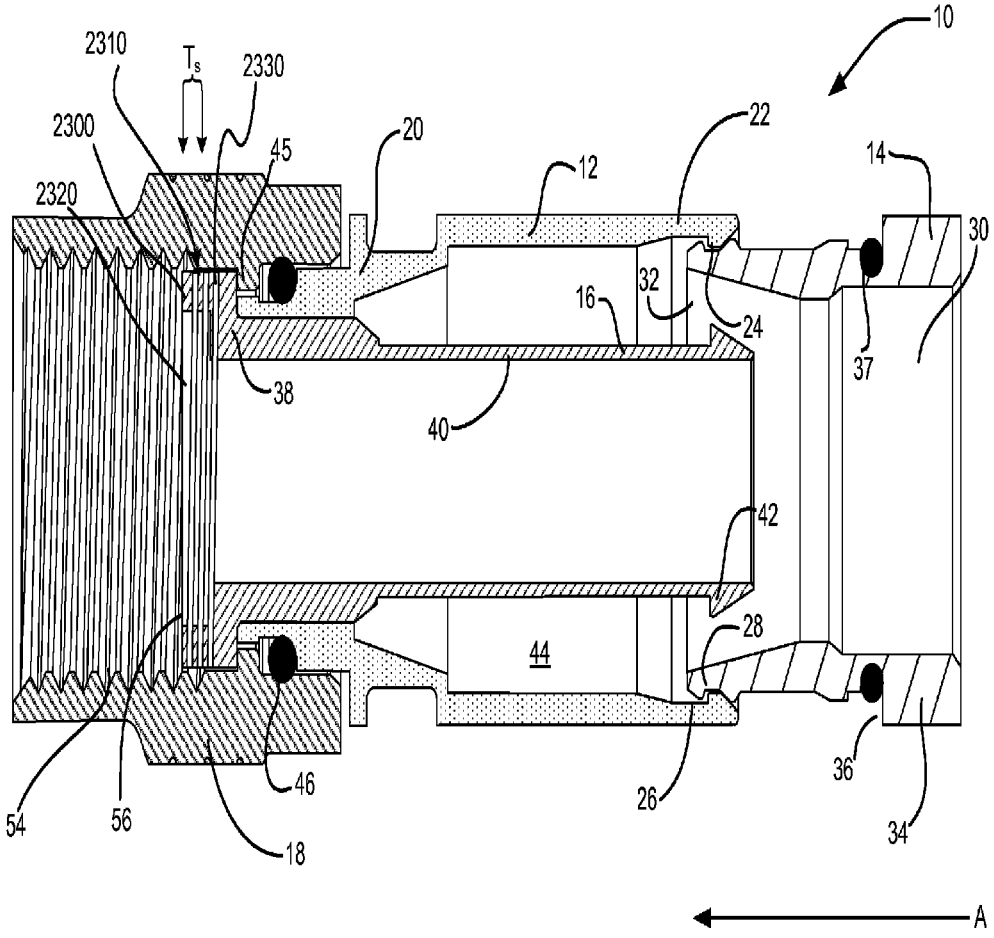
FIG. 23 is a cross-sectional view of another exemplary embodiment of the coaxial cable connector of FIG. 1 in an unconnected configuration.
Figure 24:
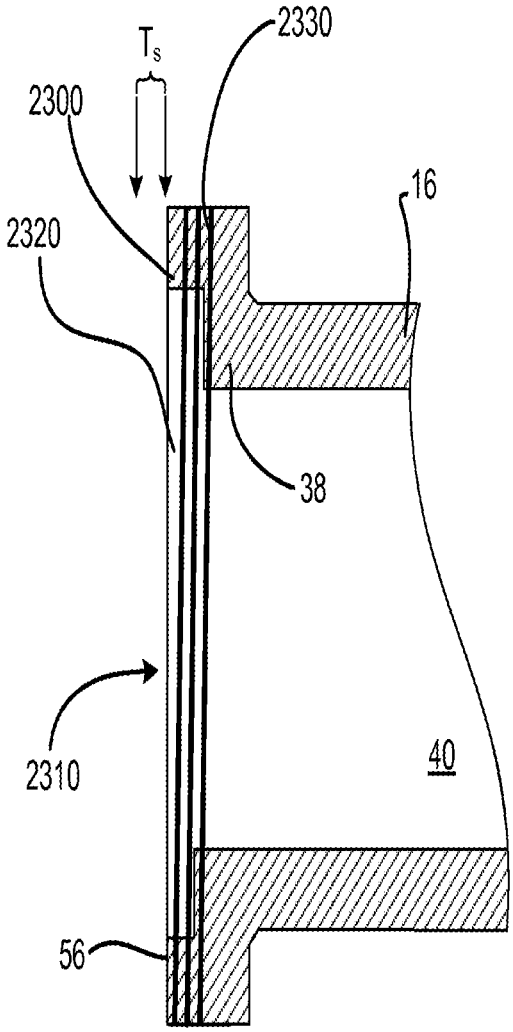
FIG. 24 is an enlarged cross-sectional view of the post of FIG. 23.

Referring now to FIGS. 23 and 24, another alternative implementation of a connector 10 is illustrated. The embodiment of FIGS. 23 and 24 is similar to the embodiment illustrated in FIG. 2, and similar reference numbers are used where appropriate. As shown in FIGS. 23 and 24, the retention force between annular nut 18 and port connector 48 (not shown in FIGS. 23 and 24) may be enhanced by providing a substantially constant load force on the port connector 48. To provide this load force, flanged base portion 38 of annular post 16 may be configured to include a spring-type biasing portion 2300 formed integrally therewith.

For example, in one implementation, annular post 16 may be formed of a conductive material, such as aluminum, stainless steel, etc. During manufacture of annular post 16, tubular extension 40 in a forwardmost portion 2310 of flanged base portion 38 may be notched, cut, or bored to form expanded opening 2320. Expanded opening 2320 reduces the thickness of the side walls of forwardmost portion 2310 of annular post 16. Thereafter, forwardmost portion 2310 of flanged base portion 38 may be machined or otherwise configured to include a helical slot 2330 therein. Helical slot 2330 may have a thickness $T_s$ dictated by the amount of forwardmost portion 2310 removed from annular post 16. In exemplary implementations, thickness $T_s$ may range from approximately 0.010 inches to approximately 0.025 inches.

Formation of helical slot 2330 effectively transforms forwardmost portion 2310 of annular post 16 into a spring, enabling biased, axial movement of forward surface 56 of annular post 16 by an amount substantially equal to the thickness $T_s$ of helical slot 2330 times the number of windings of helical slot 2330. That is, if helical slot 2330 includes three windings around forwardmost portion 2310, and $T_s$ is 0.015 inches, the maximum compression of biasing portion 2300 from a relaxed to a compressed state is approximately 0.015 times three, or 0.045 inches. It should be understood that, although helical slot 2330 in FIGS. 23 and 24 includes three windings, any suitable number of windings may be used in a manner consistent with aspects described herein. Further, because spring-type biasing portion 2300 is formed integrally with annular post 16, passage of electrical and radio frequency (RF) signals from annular post 16 to port connector 48 at varying degrees of insertion relative to port connector 48 and connector 10 may be enabled.

In an initial, uncompressed state (as shown in FIG. 23), forward surface 56 of annular post 16 may extend a distance "$T_s$" beyond a position of forward surface 56 when under maximum compressed (as shown in FIG. 24). Upon insertion of port connector 48 (not shown), rearward surface 58 of port connector 48 may come into contact with forward surface 56 of annular post 16, with biasing portion 2300 in a relaxed state (FIG. 23).

Continued insertion of port connector 48 into connector 10 may cause compression of helical slot 2330 in biasing portion 2300, thereby providing a load force between flanged base portion 38 and port connector 48. This load force may be transferred to threads 52 and 54, thereby facilitating constant tension between threads 52 and 54 and decreasing the likelihood that port connector 48 will become loosened from connector 10 due to external forces, such as vibrations, heating/cooling, etc. As described above, the configuration of helical slot 2330 may enable resilient, axial movement of forward surface 56 of annular post 16 by a distance substantially equivalent to a thickness of helical slot 2330 times a number of windings of helical slot 2330 about annular post 16.

Because biasing portion 2300 is formed integrally with annular post 16, electrical and RF signals may be effectively transmitted from port connector 48 to annular post 16 even when in biasing portion 2330 is in a relaxed or not fully compressed state, effectively increasing the reference plane of connector 10. In one implementation, the above-described configuration enables a functional gap or "clearance" of less than or equal to approximately 0.043 inches, for example 0.033 inches, between the reference planes, thereby enabling approximately 360 degrees or more of "back-off" rotation of annular nut 18 relative to port connector 48 while maintaining suitable passage of electrical and/or RF signals. Further, compression of biasing portion 2300 provides equal and opposite biasing forces between the internal threads of nut 18 and the external threads of port connector 48.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

What is claimed is:

1. A coaxial cable connector for coupling a coaxial cable to a mating connector, the coaxial cable connector comprising:
- a connector body having a forward end and a rearward cable receiving end for receiving the coaxial cable;
- a nut rotatably coupled to said forward end of said connector body;
- an annular post disposed within said connector body, said annular post having a forward flanged base portion disposed within a rearward extent of said nut, said forward flanged base portion having a forward face and a recess formed in an outer surface of the forward flanged base portion; and
- a biasing element attached to said forward flanged base portion of said annular post and having a deflectable portion extending outwardly in a forward direction beyond said forward face of said forward flanged base portion, the biasing element further comprising an attachment portion received in the recess of the forward flanged base portion.

2. The coaxial cable connector of claim 1, wherein said biasing element comprises a base portion fixed to said forward flanged base portion and a deflectable portion extending in said forward direction beyond said forward face of said forward flanged base portion.

3. The coaxial cable connector of claim 2, wherein said deflectable portion extends in a direction radially inward from said base portion of the biasing element.

4. The coaxial cable connector of claim 2, wherein said deflectable portion extends in a direction radially outward from said base portion of the biasing element.

5. The coaxial cable connector of claim 1, wherein said biasing element comprises:
- a cylindrical wall; and
- a deflectable portion disposed at a forward end of said cylindrical wall opposite said attachment portion, said deflectable portion extending in a direction radially inward from said cylindrical wall and extending in said forward direction beyond said forward face of said forward flanged base portion.

6. The coaxial cable connector of claim 1, wherein said biasing element comprises:
- a cylindrical wall;
- a retaining lip extending radially inward from a rearward end of said cylindrical wall and received in a peripheral groove of said forward flanged base portion; and
- a reverse-bent deflectable rim disposed at a forward end of said cylindrical wall opposite said retaining lip, said deflectable rim extending in a direction radially inward from said cylindrical wall and extending in said forward direction beyond said forward face of said forward flanged base portion.

7. A coaxial cable connector for coupling a coaxial cable to a mating connector, the coaxial cable connector comprising:
- a connector body having a forward end and a rearward cable receiving end for receiving the coaxial cable;
- a nut rotatably coupled to the forward end of the connector body;
- an annular post disposed within the connector body, the annular post having a forward flanged base portion located adjacent a portion of the nut;
- an annular notch formed in the forward flanged base portion; and
- a biasing element retained in the annular notch, wherein the biasing element includes a conical spring having a number of resilient, spaced apart fingers.

8. The coaxial cable connector of claim 7, wherein the biasing element includes a substantially cylindrical attachment portion formed rearward of the resilient, spaced apart fingers, wherein the attachment portion is configured to engage the annular notch to retain the biasing element to the annular post.

9. The coaxial cable connector of claim 8, wherein the attachment portion includes at least one detent located in an interior surface of the attachment portion, wherein the at least one detent engages the annular notch.

10. The coaxial cable connector of claim 9, wherein the at least one detent comprises a number of detents radially spaced around the attachment portion.

11. The coaxial cable connector of claim 7, wherein the resilient, spaced apart fingers have a radially curved configuration.

12. The coaxial cable connector of claim 7, wherein the biasing element is electrically conductive.

13. The coaxial cable connector of claim 7, wherein the resilient, spaced apart fingers are configured to compress toward the forward flanged base portion upon axial insertion of the mating connector into the nut.

14. A coaxial cable connector for coupling a coaxial cable to a mating connector, the coaxial cable connector comprising:

a connector body having a forward end and a rearward cable receiving end for receiving the coaxial cable;

a nut rotatably coupled to the forward end of the connector body;

an annular post disposed within the connector body, the annular post having a forward flanged base portion located adjacent a rearward portion of the nut; and a biasing element retained around the forward flanged base portion and configured to provide a biasing force between the annular post and the mating connector, wherein the biasing element includes a conical spring having a number of resilient, spaced apart fingers.

15. The coaxial cable connector of claim 14, wherein the biasing element includes a substantially cylindrical attachment portion formed rearward of the resilient, spaced apart fingers, wherein the attachment portion is configured to frictionally engage the flanged base portion to retain the biasing element to the annular post.

16. The coaxial cable connector of claim 14, wherein the attachment portion includes a flange.

17. A coaxial cable connector for coupling a coaxial cable to a mating connector, the coaxial cable connector comprising:

a connector body having a forward end and a rearward cable receiving end for receiving the cable;

a nut rotatably coupled to the forward end of the connector body;

an annular post disposed within the connector body, the annular post having a forward flanged base portion located adjacent a portion of the nut;

an annular notch formed in the forward flanged base portion; and a biasing element retained in the annular notch, wherein the biasing element includes an attachment portion for engaging the annular notch and a resilient central portion having an opening therethrough, wherein the resilient central portion includes a plurality of resilient members configured to apply a biasing force between the annular post and the mating connector, upon insertion of the mating connector into the nut.

18. The coaxial cable connector of claim 17, wherein the resilient central portion comprises a number of tabbed portions, wherein each tabbed portion includes a first end and a second end formed lower than the first end, wherein the biasing force between the annular post and the mating connector is caused by deflection, in each tabbed portion, of the second end toward the first end.

19. The coaxial cable connector of claim 18, wherein the attachment portion comprises a substantially octagonal attachment portion formed rearward of the resilient central portion, and wherein each tabbed portion is integrally formed substantially perpendicularly with a side of the substantially octagonal attachment portion.

20. The coaxial cable connector of claim 18, wherein the attachment portion comprises a substantially cylindrical attachment portion formed rearward of the resilient central portion, wherein the coaxial cable connector further comprises:

a number of spoke portions integrally formed substantially perpendicularly with the substantially cylindrical attachment portion, wherein each tabbed portion projects radially from one of the number of spoke portions.

21. The coaxial cable connector of claim 18, wherein the attachment portion comprises a substantially cylindrical attachment portion formed rearward of the resilient central portion, wherein the coaxial cable connector further comprises:

a hub portion integrally formed substantially perpendicularly with the substantially cylindrical attachment portion having a number of spaced openings therein, wherein each tabbed portion projects axially from one of the number of spaced openings in the hub portion.

* * * * *